US007978989B2

(12) United States Patent
Nagano et al.

(10) Patent No.: US 7,978,989 B2
(45) Date of Patent: Jul. 12, 2011

(54) TONER CARTRIDGE AND IMAGE FORMING APPARATUS

(75) Inventors: Yusuke Nagano, Yamatokoriyama (JP); Shigeru Watase, Hashimoto (JP); Hiroshi Takatani, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 510 days.

(21) Appl. No.: 12/142,947

(22) Filed: Jun. 20, 2008

(65) Prior Publication Data

US 2008/0317481 A1 Dec. 25, 2008

(30) Foreign Application Priority Data

Jun. 20, 2007 (JP) ..... 2007-163066
Jul. 17, 2007 (JP) ..... 2007-186196

(51) Int. Cl.
*G03G 15/08* (2006.01)

(52) U.S. Cl. ..... 399/27; 399/120

(58) Field of Classification Search ..... 399/27, 399/120

See application file for complete search history.

(56) References Cited

U.S. PATENT DOCUMENTS 5,652,944 A * 7/1997 Masuda et al. ..... 399/24
5,978,632 A 11/1999 Kimura et al.
6,381,420 B1 * 4/2002 Sato et al. ..... 399/27
6,687,467 B2 * 2/2004 Katoh ..... 399/30

FOREIGN PATENT DOCUMENTS

| | | |
|---|---|---|
| JP | 04-336566 | 11/1992 |
| JP | 10-288882 | 10/1998 |
| JP | 2002-304113 A | 10/2002 |
| JP | 2004-70197 A | 3/2004 |
| JP | 2006-084744 | 3/2006 |

* cited by examiner

*Primary Examiner* — David M Gray
*Assistant Examiner* — Rodney Bonnette
(74) *Attorney, Agent, or Firm* — Nixon & Vanderhye PC

(57) ABSTRACT

A toner cartridge counts the number of times the toner cartridge has been shaken by a counting unit. A control unit of an image forming apparatus acquires the counting result of the counting unit, and controls each unit of the apparatus such that a display unit displays a message encouraging the worker to shake the toner cartridge since the shaking of the toner cartridge is insufficient if the acquired counting result is smaller than a predetermined value, and the toner contained in the toner cartridge is supplied to a developing unit of the image forming apparatus since the toner cartridge is sufficiently shaken and the toner in the toner cartridge is stirred and dissolved if the acquired counting result is greater than or equal to a predetermined value.

20 Claims, 23 Drawing Sheets

TONER CARTRIDGE AND IMAGE FORMING APPARATUS

CROSS-REFERENCE TO RELATED APPLICATIONS

This Nonprovisional application claims priority under 35 U.S.C. §119(a) on Patent Application No. 2007-163066 and No. 2007-186196 filed in Japan on Jun. 20, 2007 and Jul. 17, 2007 respectively, the entire contents of which are hereby incorporated by reference.

BACKGROUND

1. Technical Field

The present technology relates to a toner cartridge enabling use while avoiding coagulation of the toner, and an image forming apparatus.

2. Description of the Related Art

The image forming apparatus such as copying machine and printer adopting an electrophotographic method includes a photosensitive drum, a toner cartridge removably attached to the image forming apparatus, and a developing unit.

When the image forming apparatus forms the image, an electrostatic latent image corresponding to an image to be formed (hereinafter referred to as image to be reproduced) on a recording sheet such as recording paper and OHP sheet is formed on the surface of the photosensitive drum. The toner cartridge supplies developer (specifically, toner) or colorant to the developing unit, and the developing unit makes the toner adhere to the electrostatic latent image formed on the surface of the photosensitive drum to develop the toner image (i.e., develop the photosensitive drum).

Such image forming apparatus irradiates light to the surface of the photosensitive drum to form the electrostatic latent image corresponding to the image to be reproduced after evenly charging the surface of the photosensitive drum. The electrification charges of the region irradiated with light at the surface of the photosensitive drum are removed, where non-removed portion becomes the electrostatic latent image. The toner is then supplied to the surface of the photosensitive drum to be adhered to the charged region (i.e., electrostatic latent image) of the surface of the photosensitive drum, and the toner image corresponding to the image to be reproduced is developed on the surface of the photosensitive drum. Finally, the image to be reproduced is formed on the recording sheet by transferring the developed toner image onto the recording sheet.

The toner in the toner cartridge is consumed as the toner cartridge supplies toner to the developing unit. High quality images become difficult to form if the amount of toner supplied from the developing unit to the photosensitive drum is insufficient, and thus the image forming apparatus detects the remaining amount of toner contained in the toner cartridge, and informs the user, the manager and the like (hereinafter referred to as worker) of the image forming apparatus when the toner is insufficient that it is time to change the toner cartridge etc. The worker who recognizes the timing to change the toner cartridge detaches the toner cartridge attached to the image forming apparatus, and attaches a new toner cartridge to the image forming apparatus. That is, an empty toner cartridge is replaced with a new toner cartridge so that toner can be replenished to the image forming apparatus.

An image forming apparatus equipped with a toner replenishing device to maintain the toner amount in the developing unit constant is also known. In such image forming apparatus, when insufficiency of toner is detected, the toner is automatically replenishing by the toner replenishing device in response to the detection. The toner amount in the developing unit is thus maintained constant, and a constant image quality is always maintained. The toner cartridge for replenishing the toner to the toner replenishing device is also used in the image forming apparatus equipped with the toner replenishing device. In this case, the worker attaches the toner cartridge to the toner replenishing device, replenishes the new toner contained in the toner cartridge to the toner container of the toner replenishing device, and detaches the toner cartridge from the toner replenishing device after replenishing is completed.

The toner is in a form of microscopic powder and has fluidity close to liquid, but if the toner cartridge is left untouched for a long period of time, the toner in the toner cartridge coagulates, whereby the fluidity lowers and a behavior close to a solid is exhibited. The toner having sufficient fluidity can be easily supplied to the developing unit, and furthermore, to the photosensitive drum, but the coagulated toner tends to retain in the toner cartridge as the fluidity is low, and becomes difficult to be supplied to the developing unit and the photosensitive drum. As a result, a drawback in that toner is insufficient at the photosensitive drum although sufficient amount of toner exists in the toner cartridge arises.

In order to prevent such drawback, the worker needs to sufficiently dissolve the toner by shaking the toner cartridge and stirring the toner in the toner cartridge before attaching the toner cartridge to the image forming apparatus. However, such shaking of the toner cartridge is manually performed by the worker, and thus some workers might attach the toner cartridge to the image forming apparatus without shaking the toner cartridge until the toner is sufficiently stirred and dissolved.

Conventionally, a toner cartridge incorporating a toner stirring member is proposed such that the toner is sufficiently stirred and dissolved even if the number of times the worker has shaken the toner cartridge is few (see e.g., Japanese Patent Application Laid Open No. 10-288882).

However, the necessity itself to shake the toner cartridge is not acknowledged by the worker, and the worker might attach the toner cartridge to the image forming apparatus without shaking. In this case, the toner is barely stirred and dissolved even if the toner cartridge disclosed in Japanese Patent Application Laid Open No. 10-288882 is used.

Even if the worker shakes the toner cartridge, the toner will not be sufficiently stirred and dissolved if the number of times the worker has shaken the toner cartridge is less than the requisite minimum number of times to shake to sufficiently stir and dissolve the toner.

Furthermore, even if the user is aware of the requisite minimum number of times to shake the toner cartridge, it is troublesome for the worker to count the number of times the worker has shaken the toner cartridge, whereby counting mistake, loss of counting result etc. may occur and the number of shaking movements may insufficient.

SUMMARY

In view of the above, the main object of the present technology is to provide a toner cartridge capable of counting the number of times the worker has shaken the toner cartridge without having the worker make the count by obtaining a configuration of counting the number of shakes.

Another object of the present technology is to provide a toner cartridge enabling the worker to accurately count the number of times the worker has shaken the toner cartridge immediately before being attached to the image forming apparatus by obtaining a configuration of not counting the shaken number of times when packaged.

Another object of the present technology is to provide a toner cartridge capable of counting the number of times the worker has shaken the toner cartridge with a simple configuration by obtaining a configuration of counting the number of times a pendulum has contacted a contacting point.

Another object of the present technology is to provide a toner cartridge capable of counting the number of times the worker has shaken the toner cartridge so that the distribution of the toner amount becomes even with a simple configuration by obtaining a configuration of counting the number of times a pendulum swinging in a direction along a longitudinal direction has contacted a contacting point.

Another object of the present technology is to provide a toner cartridge capable of counting the number of times the worker has shaken the toner cartridge in a plurality of directions with a simple configuration by obtaining a configuration of counting the number of times a pendulum swinging in a plurality of directions has contacted a contacting point.

Another object of the present technology is to provide a toner cartridge enabling the worker to recognize the number of times the worker has shaken the toner cartridge without counting by obtaining a configuration of displaying the number of times the toner cartridge has been shaken.

Another object of the present technology is to provide a toner cartridge enabling the worker to recognize the insufficiency of shaking without having the worker make the count or without having the worker be aware of the requisite minimum number of times to shake by obtaining a configuration of displaying a notice that shaking is necessary when the number of times the toner cartridge has been shaken is less than a predetermined value.

Another object of the present technology is to provide an image forming apparatus capable of supplying the sufficiently stirred and dissolved toner to the developing unit for developing the toner image by making the toner adhere to an electrostatic latent image formed on the surface of the photosensitive body by obtaining a configuration of controlling the supply of toner contained in the toner cartridge to the developing unit according to the number of times the toner cartridge has been shaken.

Another object of the present technology is to provide an image forming apparatus capable of preventing the insufficiently stirred and un-dissolved toner from being supplied to the developing unit by obtaining a configuration of prohibiting the supply of toner to the developing unit when the number of times the toner cartridge has been shaken is less than a predetermined value.

Another object of the present technology is to provide an image forming apparatus enabling the worker to recognize the number of times the worker has shaken the toner cartridge without making the count by obtaining a configuration of displaying the number of times the toner cartridge has been shaken.

Another further object of the present technology is to provide an image forming apparatus in which the worker can recognize the insufficiency of shaking of the toner cartridge without counting or without being aware the requisite minimum number of times to shake the toner cartridge by obtaining a configuration of displaying a notice that the toner cartridge needs to be shaken when the number of times the toner cartridge has been shaken is less than a predetermined value.

Another further object of the present technology is to provide a toner cartridge and an image forming apparatus to be attached with such toner cartridge capable of notifying the shaken amount of the toner cartridge based on the magnitude of the electric power stored in a storage unit by obtaining a configuration including a conversion unit for converting energy related to shaking movements of the toner cartridge to electric power, and the storage unit for storing the converted power.

A toner cartridge according to the present application relates to a toner cartridge for containing toner, the containing toner being stirred by shaking, comprising a counting unit for counting the number of shaking movements.

The toner cartridge according to the present application is characterized by further comprising a packaging detection unit for detecting whether packaged or not, wherein the counting unit maintains a counting result to zero when the packaging detection unit detects that the toner cartridge is packaged.

The toner cartridge according to the present application is characterized in that the counting unit includes a pendulum which swings in at least one direction, a contacting point to which the pendulum contacts, and a counter for counting the number of times the pendulum has contacted the contacting point.

The toner cartridge according to the present application is characterized in that a shape of the toner cartridge is a columnar shape, and the pendulum swings in a direction along a longitudinal direction.

The toner cartridge according to the present application is characterized in that the pendulum swings in a plurality of directions, and the contacting point is arranged in correspondence to each of the plurality of swinging directions of the pendulum.

The toner cartridge according to the present application is characterized by further comprising a display unit for displaying a counting result by the counting unit.

The toner cartridge according to the present application is characterized by further comprising a determining unit for determining whether or not a counting result by the counting unit is greater than or equal to a predetermined value and a display unit for displaying a notification that the toner cartridge needs to be shaken when determined as negative by the determining unit.

A toner cartridge according to the present application relates to a toner cartridge for containing toner, the containing toner being stirred by shaking, comprising a conversion unit for converting energy related to shaking movements to electric power and a storage unit for storing the electric power converted by the conversion unit.

The toner cartridge according to the present application is characterized by further comprising a detection unit for detecting a shaking amount based on the electric power stored in the storage unit and a display unit for displaying the shaking amount detected by the detection unit.

The toner cartridge according to the present application is characterized in that a rotating body rotatably supported by a predetermined rotation shaft is internally arranged, the rotating body being configured to rotate about the rotation shaft by the shaking.

The toner cartridge according to the present application is characterized in that a stirring member for stirring the toner is attached to the rotating body.

The toner cartridge according to the present application is characterized by further comprising a discharge unit for discharging the electric power stored by the storage unit.

An image forming apparatus according to the present application relates to an image forming apparatus comprising a developing unit for developing a toner image by making toner adhere to an electrostatic latent image formed on a surface of a photosensitive body, a transfer unit for transferring the toner image developed by the developing unit on a recording sheet, a toner cartridge according to claim 1 being removably attached so that the toner contained in the attached toner cartridge is supplied to the developing unit, and a control unit for controlling the supply of toner to the developing unit based on a counting result of a counting unit arranged in the toner cartridge.

The image forming apparatus according to the present application is characterized in that the control unit determines whether or not the counting result is greater than or equal to a predetermined value, and prohibits the supply of toner if determined as negative.

The image forming apparatus according to the present application is characterized by further comprising a notifying unit for notifying the counting result.

The image forming apparatus according to the present application is characterized by further comprising a determining unit for determining whether or not the counting result is greater than or equal to a predetermined value and a notifying unit for notifying that the toner cartridge needs to be shaken when the determining unit determines negative.

An image forming apparatus according to the present application relates to an image forming apparatus comprising a developing unit for developing a toner image by making toner adhere to an electrostatic latent image formed on a surface of a photosensitive body, a transfer unit for transferring the toner image developed by the developing unit on a recording sheet, an attachment unit to which the toner cartridge according to claim 8 is removably attached, and a replenishing unit for replenishing to the developing unit the toner contained in the toner cartridge attached to the attachment unit.

The image forming apparatus according to the present application is characterized by further comprising a detection unit for detecting electric power stored in the toner cartridge and a control unit for controlling a replenishing operation of the toner by the replenishing unit according to the detection result of the detection unit.

The image forming apparatus according to the present application is characterized by further comprising a determining unit for determining whether or not the electric power detected by the detection unit is greater than or equal to a predetermined value and a notifying unit for notifying that the toner cartridge needs to be shaken when the determining unit determines negative.

The image forming apparatus according to the present application is characterized in that the toner cartridge includes a toner replenishing valve, the toner replenishing valve being opened by the control of the control unit when determined that the electric power detected by the detection unit is greater than or equal to the predetermined value.

In the present application, the toner cartridge includes a counting unit.

The toner cartridge contains toner, where the toner contained in the toner cartridge is stirred and dissolved by having the worker shake the toner cartridge.

The counting unit counts the number of times the toner cartridge has been shaken. The worker thus does not need to count the number of times the worker has shaken the toner cartridge. That is, miscounting of the number of times the toner cartridge has been shaken, losing of count will not occur, and the number of times the toner cartridge has been shaken can be accurately counted.

In the present application, the toner cartridge including the counting unit further includes a packaging detection unit.

The packaged toner cartridge is naturally shaken during transportation etc., but such shaking is not the shaking to stir and dissolve the toner contained in the toner cartridge, and even if the toner is dissolved by such shaking, a long period of time may possibly elapse until the toner cartridge is attached to the image forming apparatus after the shaking, and the toner might coagulate during that time.

The unpackaged toner cartridge has a high possibility of being attached to the image forming apparatus in a short period of time after being shaken by the worker to stir and dissolve the toner contained in the toner cartridge.

Therefore, in order to count the shaken number of times to stir and dissolve the toner immediately before attaching the toner cartridge to the image forming apparatus, and to prevent the shaking other than such shaking from being mistakenly counted, the packaging detection unit detects whether the toner cartridge is packaged, and the counting unit maintains the counting result to zero when the packaging detection unit detects that the toner cartridge is packaged. The counting unit repeats non-execution of the shake counting itself or clearing of the counting result to zero at an appropriate timing when detected that the toner cartridge is packaged.

When the packaging detection unit does not detect that the toner cartridge is packaged (i.e., when detecting that toner cartridge is not packaged), the counting unit counts the number of times the toner cartridge has been shaken. As a result, the worker can accurately count the number of times the worker has shaken the toner cartridge immediately before attaching the toner cartridge to the image forming apparatus.

In the present application, the counting unit arranged in the toner cartridge includes a pendulum, contacting point, and a counter.

The pendulum swings in at least one direction. Thus, the pendulum swings in the relevant direction when the worker shakes the toner cartridge in the relevant direction.

When one contacting point is arranged, the pendulum and the contacting point contact once for every reciprocation of the pendulum, and when two contacting points are arranged spaced apart in the relevant direction, the pendulum and the contacting point contact twice for every reciprocation of the pendulum.

The counter counts the number of times the pendulum has contacted the contacting point. Therefore, the counting result of the counter corresponds to the number of times the toner cartridge has been shaken.

As a result, the number of times the worker has shaken the toner cartridge can be counted with a simple configuration using the pendulum, the contacting point, and the counter.

In the present application, the counting unit arranged in the toner cartridge includes a pendulum which swings in a direction along a longitudinal direction of the toner cartridge, a contacting point, and a counter. Generally, the longitudinal direction of a column-shaped toner cartridge is the length direction of the column.

The toner contained in the toner cartridge may have uneven distribution of toner amount in the longitudinal direction of the toner cartridge. The toner cartridge needs to be shaken in the longitudinal direction to even the distribution of toner amount in the longitudinal direction of the toner cartridge.

When the worker shakes the toner cartridge in the longitudinal direction of the toner cartridge, the pendulum swings in the direction along the longitudinal direction and contacts the contacting point. The counter counts the number of times the pendulum has contacted the contacting point. Therefore, the counting result of the counter corresponds to the number of times the toner cartridge has been shaken in the longitudinal direction.

As a result, the number of times the worker has shaken the toner cartridge so that the distribution of toner amount in the longitudinal direction of the toner cartridge becomes even can be counted with a simple configuration.

In the present application, the counting unit arranged in the toner cartridge includes a pendulum which swings in a plurality of directions, contacting points arranged in correspondence to each of the plurality of swinging directions of the pendulum, and a counter.

The toner cartridge does not necessarily swing only in one direction. The toner contained in the toner cartridge is easily stirred and dissolved when the toner cartridge is shaken in a plurality of directions compared to when shaken only in one direction. Furthermore, the distribution of toner amount in the toner cartridge easily becomes even.

When the worker shakes the toner cartridge in a plurality of directions, the pendulum swings in the plurality of swinging directions, and contacts the contacting point. The counter counts the number of times the pendulum has contacted the contacting point. Therefore, the counting result of the counter corresponds to the number of times the toner cartridge has been shaken in the plurality of directions.

As a result, the number of times the worker has shaken the toner cartridge in the plurality of directions can be counted with a simple configuration.

In the present application, the toner cartridge including the counting unit further includes display unit for displaying the counting result.

The counting unit counts the number of times the toner cartridge has been shaken, and the display unit displays the counting result of the counting unit, that is, the number of the times the worker has shaken the toner cartridge.

Thus, the number of times the worker has shaken the toner cartridge can be easily recognized before attaching the toner cartridge to the image forming apparatus without the worker making the count.

In the present application, the toner cartridge including the counting unit further includes a determining unit and a display unit for displaying a notification that shaking is necessary.

The counting unit counts the number of times the toner cartridge has been shaken, the determining unit determines whether or not the counting result of the counting unit, that is, the number of times the worker has shaken the toner cartridge is greater than or equal to a predetermined value, and the display unit displays a notification that toner cartridge needs to be shaken when determined as negative (i.e., when determined that the counting result of the counting unit is smaller than a predetermined value).

Thus, the worker can easily recognize the insufficiency in shaking of the toner cartridge before attaching the toner cartridge to the image forming apparatus even when the worker himself/herself does not count the number of times the worker has shaken the toner cartridge, even when the worker does not know the requisite minimum number of times for the toner to be sufficiently stirred and dissolved, and without the worker comparing requisite minimum shaking number of times and the counting result. When the shaking is insufficient, the toner cartridge can be shaken additionally.

When the toner cartridge is sufficiently shaken, the notification that the toner cartridge needs to be shaken is not displayed, and thus the worker can easily recognize that the worker has sufficiently shaken the toner cartridge before attaching the toner cartridge to the image forming apparatus.

In the present application, the toner cartridge includes a conversion unit and a storage unit.

The toner cartridge contains the toner, where the toner contained in the toner cartridge is stirred and dissolved by having the worker shake the toner cartridge.

The energy related to shaking movements of the toner cartridge are converted to electric power by the conversion unit, and stored by the storage unit. That is, the electric power corresponding to the shaking amount (shaken number of times) of the toner cartridge is stored in the storage unit. The magnitude of the electric power stored in the storage unit thus becomes the value reflecting the shaking amount (shaken number of times) of the toner cartridge.

In the present application, the user can determine whether or not coagulation of the toner is sufficiently dissolved since the shaking amount of the toner cartridge is displayed.

In the present application, a rotating body which rotates by the shaking of the toner cartridge is arranged, and thus the shaking amount of the toner cartridge is detected as the rotation amount of the rotating body.

In the present application, the toner in a toner container is efficiently stirred by shaking the toner cartridge.

In the present application, the electric power stored in the storage unit at the start of shaking is discharged so that only the electric power arising from the shaking of the toner cartridge is stored in the storage unit. Thus, the shaking amount of the toner cartridge is accurately detected.

In the present application, the image forming apparatus includes a developing unit, a transfer unit, and a control unit, where the toner cartridge described above is removably attached to the image forming apparatus, and the toner contained in the attached toner cartridge is supplied to the developing unit.

The toner cartridge contains the toner, where the toner contained in the toner cartridge is stirred and dissolved by having the worker shake the toner cartridge. The counting unit arranged in the toner cartridge counts the number of times the toner cartridge has been shaken.

When the counting result of the counting unit is large, the number of times the toner cartridge has been shaken is large, and thus the toner contained in the toner cartridge is assumed to be sufficiently stirred and dissolved. When the counting result of the counting unit is small, the number of times the toner cartridge has been shaken is small, and thus the toner contained in the toner cartridge is assumed to be insufficiently stirred and is coagulated.

The control unit controls the supply of toner to the developing unit based on the counting result of the counting unit. To this end, the image forming apparatus includes a toner supply mechanism for supplying toner contained in the toner cartridge to the developing unit, and the control unit controls the operation of the toner supply mechanism to supply the toner contained in the toner cartridge to the developing unit when the counting result of the counting unit is large.

When the toner is supplied, the developing unit develops a toner image by making toner adhere to an electrostatic latent image formed on the surface of a photosensitive body, and the transfer unit transfers the toner image developed by the developing unit on a recording sheet. Therefore, the sufficiently stirred and dissolved toner is supplied to the developing unit and furthermore to the transfer unit, and an image forms on the recording sheet.

When the counting result of the counting unit is small, the toner contained in the toner cartridge is not supplied to the developing unit. Thus, the insufficiently stirred and coagulated toner is not supplied to the developing unit nor to the transfer unit, and the image does not form on the recording sheet.

In the present application, the control unit of the image forming apparatus determines whether or not the counting result of the counting unit of the toner cartridge is greater than or equal to a predetermined value, and prohibits the supply of toner to the developing unit when determined as negative (i.e., when determined that counting result of the counting unit is smaller than a predetermined value). When determining that the counting result of the counting unit is greater than or equal to the predetermined value, the control unit executes the supply of toner to the developing unit.

When the counting result of the counting unit is smaller than the predetermined value, the toner contained in the toner cartridge is assumed to be insufficiently stirred and coagulated. Therefore, the insufficiently stirred and coagulated toner is prevented from being supplied to the developing unit and to the transfer unit, and image is prevented from being formed on the recording sheet using such toner.

In the present application, the image forming apparatus further includes a notifying unit for notifying the counting result by the counting unit of the toner cartridge.

The counting unit of the toner cartridge counts the number of times the toner cartridge has been shaken, and the notifying unit displays the counting result of the counting unit, that is, the number of times the worker has shaken the toner cartridge.

Thus, the worker can easily recognize the number of times the worker has shaken the toner cartridge even after attaching the toner cartridge to the image forming apparatus without the worker himself/herself making the count.

In the present application, the image forming apparatus further includes a determining unit, and a notifying unit for notifying that shaking is necessary.

The counting unit of the toner cartridge counts the number of times the toner cartridge has been shaken, the determining determines whether or not the counting result of the counting unit, that is, the number of times the worker has shaken the toner cartridge is greater than or equal to a predetermined value, and the notifying unit notifies that the toner cartridge needs to be shaken when determined as negative (i.e., when determined that the counting result of the counting unit is smaller than the predetermined value).

Thus, the worker can easily recognize the insufficiency of shaking of the toner cartridge even after attaching the toner cartridge to the image forming apparatus even if the worker himself/herself is not counting the number of times the worker has shaken the toner cartridge, or even if the worker himself/herself does not know the requisite number of times for the toner to be sufficiently stirred and dissolved, and furthermore, without the worker himself/herself comparing the requisite minimum number of times to shake and the counting result. Furthermore, when shaking is insufficient, the toner cartridge can be once detached from the image forming apparatus to be further shaken.

When the toner cartridge is sufficiently shaken, notification that toner cartridge needs to be shaken is not displayed, and thus the worker can easily recognize that the worker himself/herself has sufficiently shaken the toner cartridge even after attaching the toner cartridge to the image forming apparatus.

In the present application, the image forming apparatus includes a developing unit, a transfer unit, an attachment unit to be attached with the above described toner cartridge, and a replenishing unit for replenishing the toner contained in the attached toner cartridge to the developing unit.

Since the electric power corresponding to the shaking amount (shaken number of times) is stored in the toner cartridge, the possibility that the sufficient number of shaking has not been performed is high when the magnitude of the stored electric power is small, and thus shaking can be encouraged on the user. As a result, the toner cartridge can be attached with the toner contained therein in a sufficiently dissolved state.

In the present application, the replenishing operation of the toner is controlled according to the electric power stored in the toner cartridge, and thus the toner is replenished to the developing device only when the toner contained in the toner cartridge is sufficiently dissolved.

In the present application, when the electric power stored in the toner cartridge is smaller than a predetermined value, determination is made that the toner in the toner cartridge is not in a sufficiently dissolved state, and thus shaking of the toner cartridge is encouraged to replenish the toner in a dissolved state.

In the present application, the toner is replenished to the developing device only when the electric power of greater than or equal to a predetermined value is stored in the toner cartridge, that is, when the toner cartridge is sufficiently shaken and the toner therein is in a sufficiently dissolved state.

In the case of the toner cartridge of the present application, the worker himself/herself does not need to count the number of times the worker has shaken the toner cartridge, and thus the convenience of the worker can be enhanced. Furthermore, miscounting the number of times the toner cartridge has been shaken or losing count of number of times does not occur, and the number of times the toner cartridge has been shaken can be accurately counted.

In the case of the image forming apparatus of the present application, the toner contained in the toner cartridge is supplied or not supplied to the developing unit depending on the number of times the toner cartridge has been shaken. Thus, image can be formed using the sufficiently stirred toner when the number of times the toner cartridge has been shaken is sufficient and thus the toner is sufficiently stirred. As a result, the coagulated toner is prevented from being unnecessarily used when the number of times the toner cartridge has been shaken is insufficient or the toner cartridge is not shaken at all.

The above and further objects and features will more fully be apparent from the following detailed description with accompanying drawings.

DETAILED DESCRIPTION

Embodiments of the technology will be described in detail based on the drawings.

First Embodiment

Figure 1:
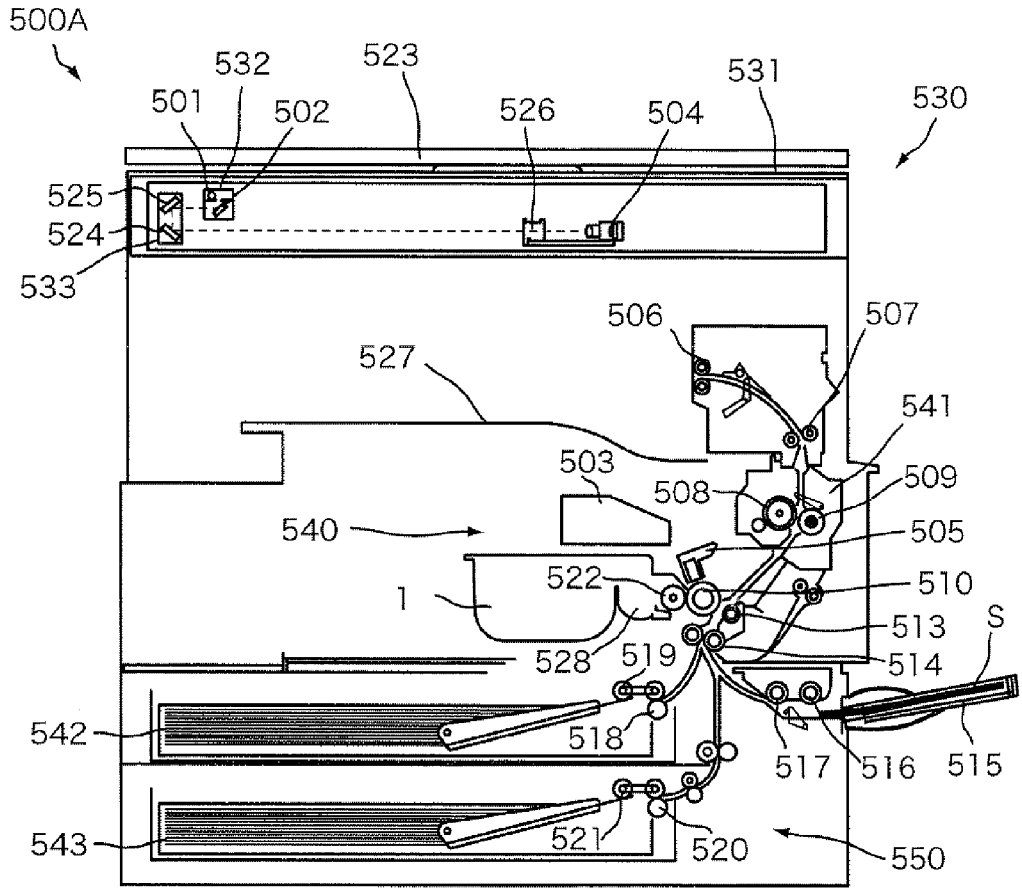
FIG. 1 is a front view showing an internal configuration of an image forming apparatus according to a first embodiment.

FIG. 1 is a front view showing an internal configuration of an image forming apparatus according to the first embodiment. In the figure, 500A is the image forming apparatus, which image forming apparatus 500A is equipped with an image reading unit 530 at the upper part, an image forming unit 540 at the middle in the up and down direction, and a paper feeding unit 550 at the lower part, and has a copy function and a printer function. The overall configuration of the image forming apparatus 500A will be described first.

A document board 531 of glass body having translucency is arranged at the upper surface of the image forming apparatus 500A. A document cover 523 for pressing down the document to the document board 531 is arranged above the document board 531.

The image reading unit 530 is positioned at the lower side of the document board 531. The image reading unit 530 includes a first scanning unit 532, a second scanning unit 533, an optical lens 526, and a CCD line sensor 504 or a photoelectric conversion element, and reads the image of the document placed on the document board 531 by relatively scanning the same at a predetermined exposure position.

The first scanning unit 532 is mounted with a light source lamp unit 501 for exposing the document surface, and a first mirror 502 for reflecting the reflected light image from the document in a predetermined direction.

The second scanning unit 533 is mounted with a second mirror 525 and a third mirror 524 for guiding the reflected light image from the document reflected by the first mirror 502 to the CCD line sensor 504.

The optical lens 526 images the reflected light from the document on the light receiving surface of the CCD line sensor 504.

The image data of the image read by the CCD line sensor 504 is transferred to the image forming unit 540.

The image forming unit 540 is arranged with a photosensitive drum 510, a charger 505 for charging the photosensitive drum 510 to a predetermined potential, a laser scan unit 503 for emitting the laser light according to the image data transferred from the document reading unit 530 or an external device and forming an electrostatic latent image on the photosensitive drum 510, a developing unit 528 for developing a toner image by supplying toner to the electrostatic latent image formed on the photosensitive drum 510 through a development roller 522, and a transfer device 513 for transferring the toner image formed on the photosensitive drum 510 onto a recording paper S or a recording sheet.

A toner cartridge 1 according to the first embodiment has a column-shaped outer appearance, and is removably attached to the developing unit 528 in an orientation the longitudinal direction lies in the front and back direction (direction perpendicular to plane of drawing of FIG. 1) of the image forming apparatus 500A to supply toner to the developing unit 528. A concentration sensor (not shown) for detecting the toner concentration in the developing unit 528 is attached proximate to the developing unit 528.

The laser scan unit 503 incorporates a semiconductor laser for irradiating a laser light modulated based on the image data, a polygon mirror for polarizing the laser light in the main scanning direction by rotation, a lens group and the like (not shown).

Furthermore, the image forming unit 540 is arranged with a fixing unit 541 for fixing the toner image on the recording paper S by heating and pressurizing the recording paper S to which the toner image is transferred. The fixing unit 541 includes a pair of rollers, a heating roller 508 on the upper side and a pressurizing roller 509 on the lower side. The heating roller 508 is equipped with a heater, so that the temperature of the heating roller 508 is detected by a temperature sensor to be temperature controlled.

The recording paper S fixed with the toner image by the fixing unit 541 is conveyed by discharge rollers 506, 507, and discharged to a discharge tray 527.

The paper feeding unit 550 includes a hand feeding tray 515 attached to the side surface of the image forming apparatus 500A, and paper feeding trays 542, 543 arranged at the lower most part of the image forming apparatus 500A. The paper feeding trays 542, 543 accommodate a plurality of recording papers S in a stacked manner. The paper feeding unit 550 includes conveyance means such as rollers 519, 518, 521, 520, 516, 517, and 514 for conveying the recording paper S supplied from the paper feeding trays 542, 543 and the hand feeding tray 515 to a transfer position between the photosensitive drum 510 and the transfer device 513 in the image forming unit 540.

In the image forming apparatus 500A formed as above, the photosensitive drum 510 serves as a photosensitive body, the developing unit 528 serves as a developing unit, and the transfer device 513 serves as a transfer unit.

The configuration of the toner cartridge 1 will now be described. The image forming apparatus 500A excluding the toner cartridge 1 is referred to as an image forming apparatus 500A body.

Figure 2:
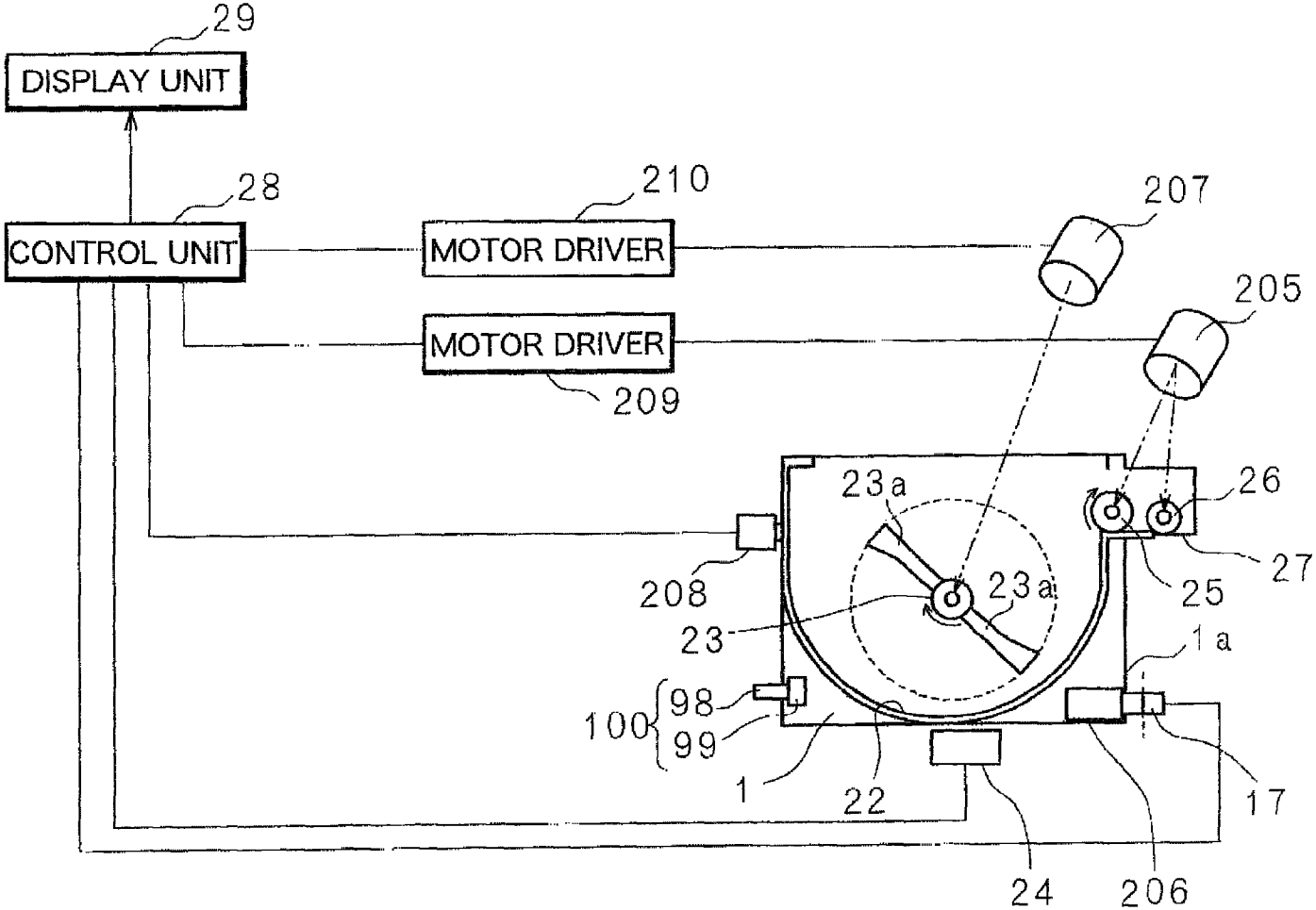
FIG. 2 is a block diagram showing a state in which a toner cartridge is attached to the image forming apparatus according to the first embodiment.

As shown in FIG. 2 to be hereinafter described, the image forming apparatus 500A body is arranged with a control unit 28 integrally including a connector 17, a toner amount sensor 24, a CPU, a ROM, a RAM, and an I/O, a display unit 29 using a liquid crystal panel; a toner conveyance motor 205, a toner stirring motor 207, an attachment detection sensor 208, and motor drivers 209, 210.

FIG. 2 is a block diagram showing a state in which the toner cartridge is attached to the image forming apparatus according to the first embodiment.

Figure 3:
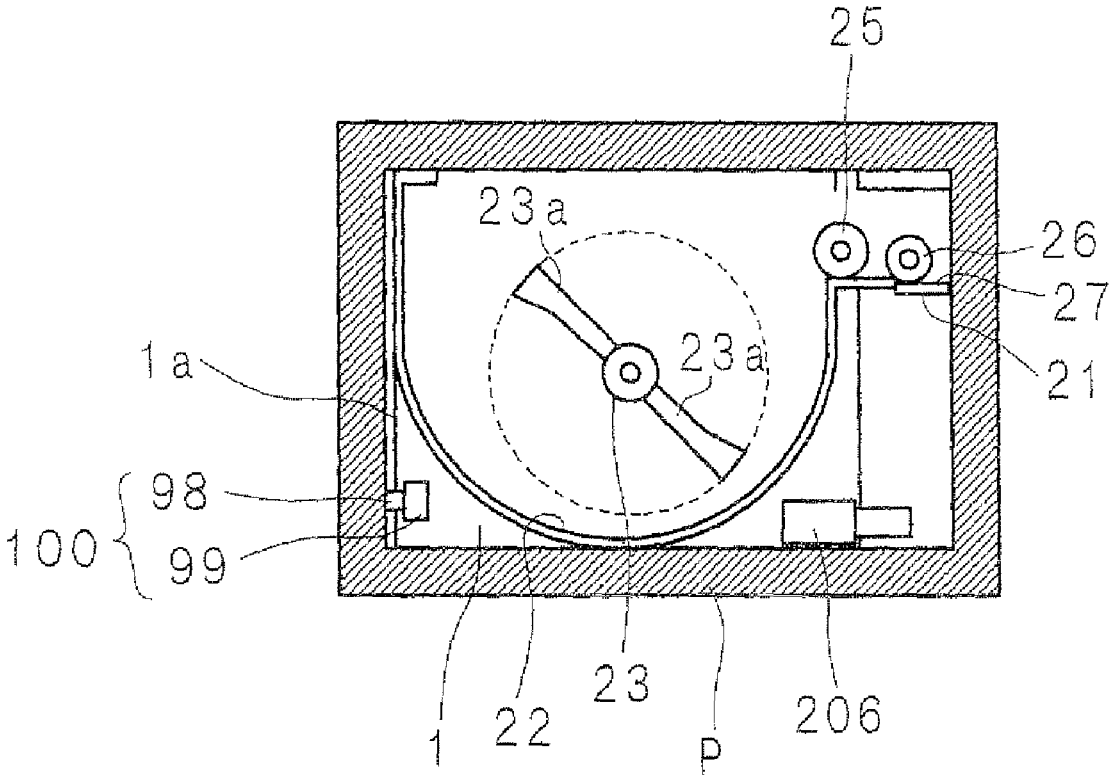
FIG. 3 is a longitudinal cross sectional view showing a state in which the toner cartridge according to the first embodiment is packaged.
Figure 4:
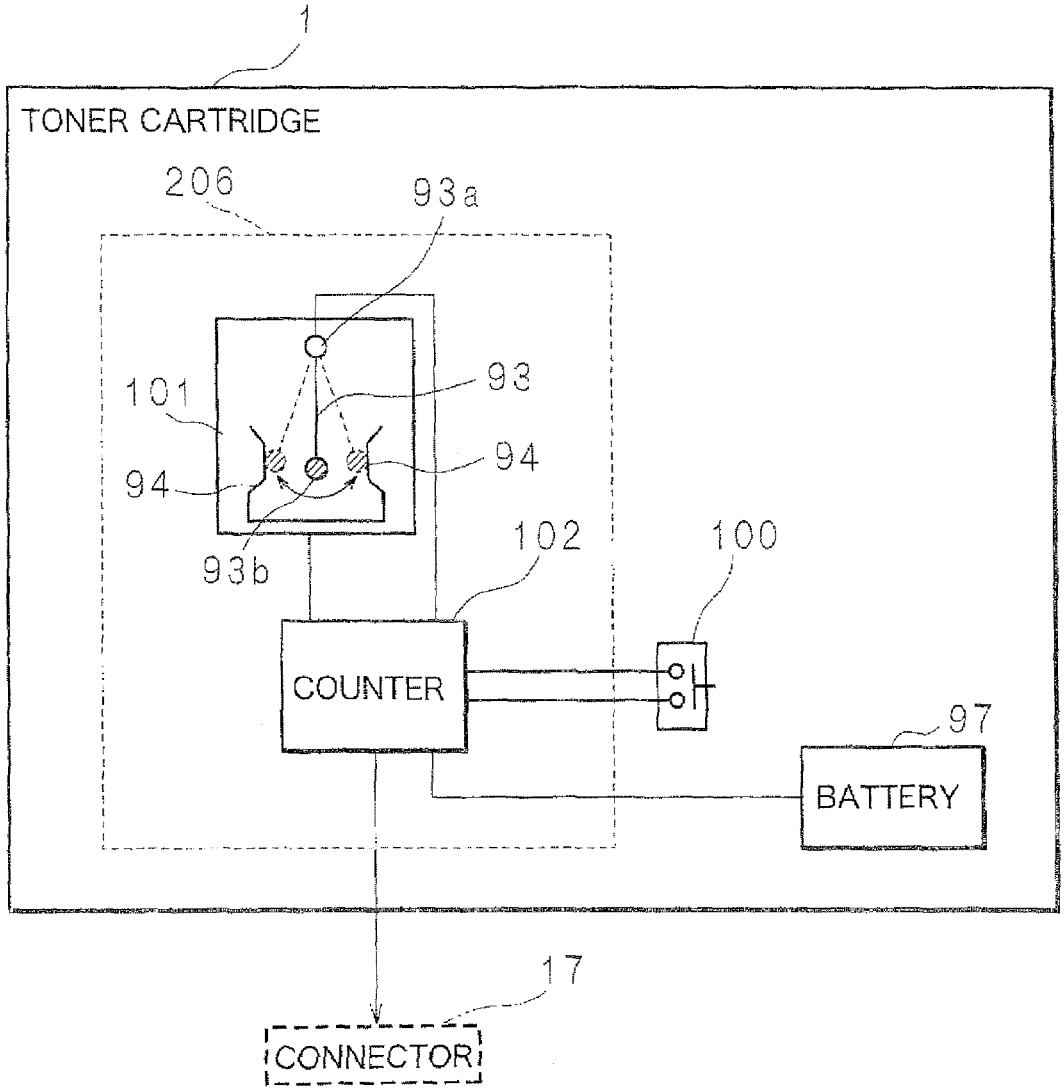
FIG. 4 is a block diagram showing a counting unit arranged in the toner cartridge according to the first embodiment.

FIG. 3 is a longitudinal cross sectional view showing a state in which the toner cartridge according to the first embodiment is packaged, and FIG. 4 is a block diagram showing a counting unit arranged in the toner cartridge according to the first embodiment.

In the figure, 1 denotes the toner cartridge, and a toner container 22 for containing the toner, a stirring roller 23 having paddles 23*a*, 23*a* arranged in a projecting manner at the peripheral surface, and a conveyance roller 25 and a discharge roller 26 are incorporated in a housing 1*a* of the toner cartridge 1, as shown in FIGS. 2 and 3, where a toner supply port 27 is also formed at the housing 1*a*.

When the stirring roller 23 is rotated, the paddles 23*a*, 23*a* stir the toner contained in the toner container 22, and the conveyance roller 25 conveys the stirred toner to the outside of the toner container 22. The discharge roller 26 discharges the toner conveyed by the conveyance roller 25 to the developing unit 528 through the toner supply port 27.

In time of factory shipment, a seal 21 for sealing the toner supply port 27 is attached to the toner supply port 27. The seal 21 is removed by the worker by hand after attaching the toner cartridge 1 to the image forming apparatus 500A body.

The toner cartridge 1 is arranged with a counting unit 206 for counting the number of times the toner cartridge 1 itself has been shook before the toner cartridge 1 is attached to the image forming apparatus 500A (i.e., number of times the worker has shaken the toner cartridge 1 before attaching the toner cartridge 1 to the image forming apparatus 500A; hereinafter referred to as shaken number of times). Furthermore, a reset switch 100 for resetting the counting result of the counting unit 206 to "0" is arranged in the toner cartridge 1.

The reset switch 100 includes a cylindrical detection unit 98 and a housing 99 for accommodating a basal end of the detection unit 98, where the detection unit 98 is turned ON when pushed, and turned OFF when pushing is released.

The distal end of the detection unit 98 is normally biased by a spring (not shown) incorporated in the housing 99 to project to the outside of the housing 1*a* from the housing 99. In this state, the reset switch 100 is turned OFF.

The reset switch 100 is turned ON when external force is applied to the detection unit 98, and the detection unit 98 is pushed into the housing 99.

In other words, the reset switch 100 serves as a packaging detection unit for detecting whether or not the toner cartridge 1 is packaged, and is turned ON if packaged and turned OFF if not packaged.

As shown in FIG. 3, if the toner cartridge 1 is packaged by a packaging member P, the detection unit 98 of the reset switch 100 is pushed by the packaging member P and pushed into the housing 99, and thus the reset switch 100 is turned ON.

As shown in FIG. 2, if the toner cartridge 1 is unpacked and the packaging member P is removed, the detection unit 98 which pressing by the packaging member P is released is biased by the spring in the housing 99 to project out from the housing 99, and thus the reset switch 100 is turned OFF.

That is, the reset switch 100 is turned ON from the time of factory shipment of the toner cartridge 1 until the worker removes the packaging member P. After the worker removes the packaging member P, the reset switch 100 is turned OFF even if the toner cartridge 1 is attached to the image forming apparatus 500A body.

As shown in FIG. 4, the toner cartridge 1 further includes a battery 97 for supplying electric power to the counting unit 206. The counting unit 206 includes a pendulum unit 101 and a counter unit 102.

The pendulum unit 101 is configured by a pendulum 93 which swings in at least one direction, and two contacting points 94, 94 arranged spaced apart in the relevant one direction.

The pendulum 93 has a spindle 93*b* suspended from a supporting point 93*a* reciprocating in at least one direction with the supporting point 93*a* as a center to alternately contact the contacting points 94, 94. A guiding part for guiding the reciprocation of the spindle 93*b* so that the reciprocation of the spindle 93*b* is limited to one direction is arranged in the pendulum unit 101.

The pendulum 93 and the contacting points 94, 94 respectively have electrical conductivity, where the supporting point 93*a* and the contacting points 94, 94 are connected to a counter 102, and the supporting point 93*a* and the contacting point 94 become electrically conductive when the spindle 93*b* contacts one contacting point 94.

The counter 102 generates a pulse when the reset switch 100 is turned OFF and the supporting point 93*a* and the contacting point 94 are electrically conducted, and counts the generated pulse (i.e., the counting result is incremented by "1" every time one pulse is generated).

When the reset switch 100 is turned ON, the electric power supply from the battery 97 to the counter 102 is short circuited, and thus the pulse cannot be generated in the reset switch 100. Thus, the counting of the pulse by the counter 102 cannot be executed regardless of the whether or not the spindle 93*b* has contacted the contacting point 94. That is, the counting result of the counter 102 is maintained at "0" as the reset switch 100 is turned ON.

The counter 102 is connected to the connector 17 arranged in the image forming apparatus 500A body when the toner cartridge 1 is attached to the image forming apparatus 500A body (see FIG. 2).

The toner conveyance motor 205 shown in FIG. 2 rotatably drives the conveyance roller 25 and the discharge roller 26, and the toner stirring motor 207 rotatably drives the stirring roller 23. The control unit 28 is a control center for controlling the operation of the image forming apparatus 500A body, and controls drive/stop of each of the toner conveyance motor 205 and the toner stirring motor 207 through the motor drivers 209, 210. More specifically, the motor driver 209 (or motor driver 210) is controlled by the control unit 28, and drives or stops the toner conveyance motor 205 (or toner stirring motor 207) by supplying the necessary electric power to the toner conveyance motor 205 (or toner stirring motor 207) or stopping the electric power supply.

The toner is charged by the rotational operation of various rollers 23, 25, 26 by the driving of the toner conveyance motor 205 and the toner stirring motor 207, or the rotation speed, the timing to start/stop rotation, and the like of various rollers 23, 25, 26 are controlled by the control unit 28, so that an appropriate amount of toner is supplied from the toner supply port 27 to the developer 528 as necessary. That is, the control unit 28 controls the supply of toner to the developing unit 528.

The control unit 28 controls the display unit 29 and displays various messages. The connector 17, the toner amount sensor 24, and the attachment detection sensor 208 are connected to the control unit 28.

The attachment detection sensor 208 detects whether or not the toner cartridge 1 is attached to the image forming apparatus 500A body, and provides an attachment detection signal indicating that the toner cartridge 1 is attached to the image forming apparatus 500A to the control unit 28 when detecting that the toner cartridge 1 is attached.

The toner amount sensor 24 detects the remaining amount of toner inside the toner container 22 of the toner cartridge 1, and provides a toner remaining amount signal corresponding to the magnitude of the remaining amount of toner to the control unit 28.

Figure 5:
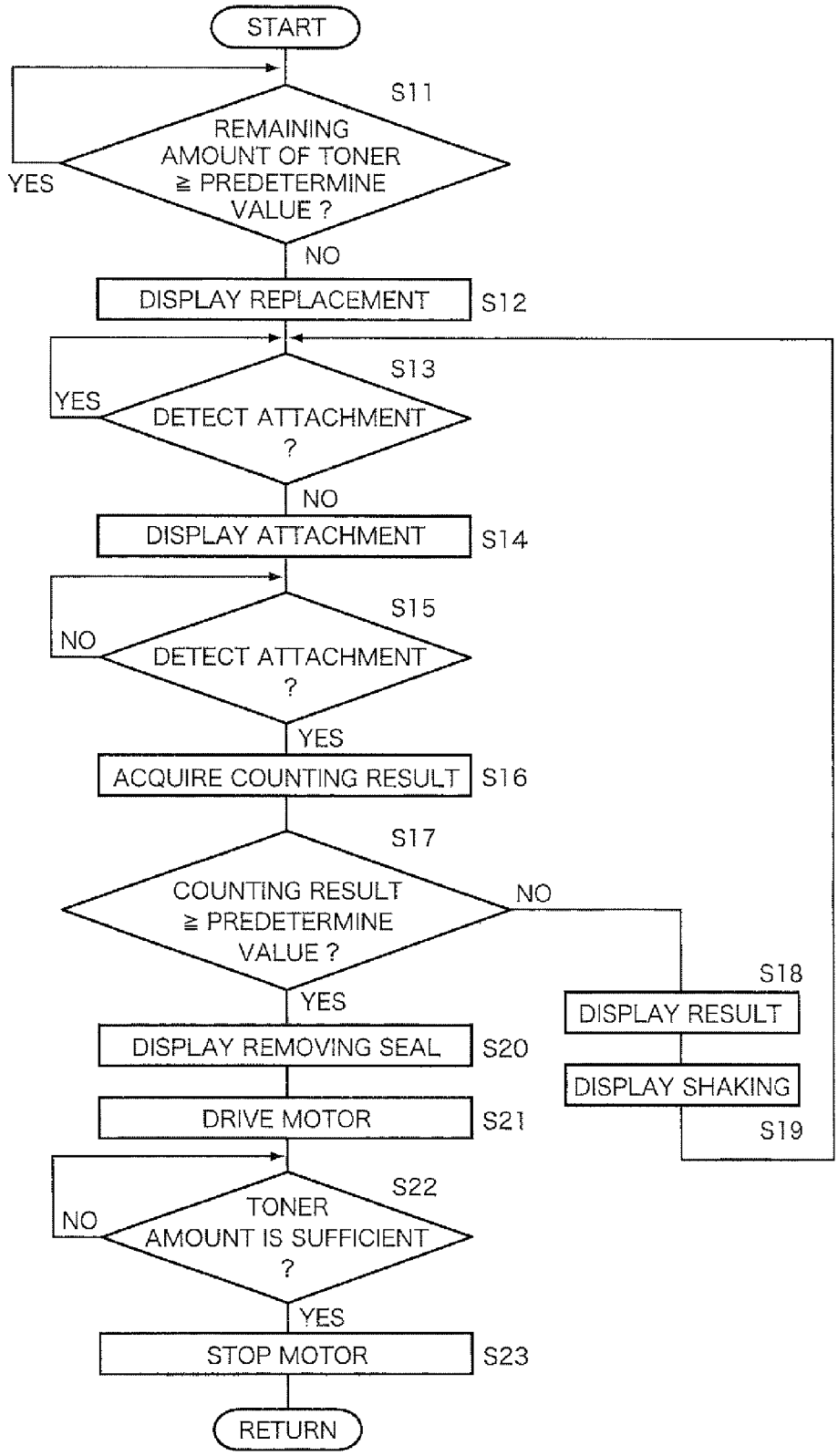
FIG. 5 is a flowchart showing a procedure of a toner replenishing process executed by the control unit of the image forming apparatus according to the first embodiment.

FIG. 5 is a flowchart showing a procedure of a toner replenishing process executed by the control unit of the image forming apparatus according to the first embodiment.

When provided with the attachment detection signal from the attachment detection sensor 208, the control unit 28 determines whether or not the remaining amount of toner inside the toner container 22 is greater than or equal to a predetermined amount based on the toner remaining amount signal provided from the toner amount sensor 24 (S11), and repeats the process of S11 if the remaining amount of toner is greater than or equal to the predetermined amount (YES in S11).

Since sufficient amount of toner is contained in the toner container 22 of the toner cartridge 1, sufficient amount of toner is supplied from the toner cartridge 1 to the developing unit 528, and sufficient amount of toner is supplied from the developing unit 528 to the photosensitive drum 510. Furthermore, the toner image formed on the photosensitive drum 510 is transferred onto the recording paper S in the transfer device 513, and a high quality image is formed on the recording paper S.

If the remaining amount of toner inside the toner container 22 is less than a predetermined amount (NO in S11), the amount of toner contained in the toner container 22 is insufficient, and thus the control unit 28 displays on the display unit 29 a message encouraging the worker to change the attached toner cartridge 1 (i.e., empty toner cartridge 1) to a new toner cartridge 1 (S12). Furthermore, the control unit 28 determines whether or not the attachment detection signal is provided from the attachment detection sensor 208 (S13), and repeats the process of S13 if the attachment detection signal is provided (YES in S13) since the empty toner cartridge 1 is still attached to the image forming apparatus 500A body.

Even if image formation is performed in this state, sufficient amount of toner is not supplied from the toner cartridge 1 to the photosensitive drum 510 through the developing unit 528. As a result, the quality of the image formed on the recording paper S degrades.

When the message encouraging to change the toner cartridge 1 is displayed on the display unit 29, the worker opens the door (not shown) of the image forming apparatus 500A body, and detaches the toner cartridge 1 attached to the image forming apparatus 500A body. The worker then prepares a new toner cartridge 1, removes the packaging member P of the relevant toner cartridge 1, and shakes the toner cartridge 1. It should be noted that the seal 21 sealing the toner supply port 27 of the toner cartridge 1 is not yet removed.

When the packaging member P is removed, the reset switch 100 is turned OFF in the toner cartridge 1, so that the pulse can be counted with the counter 102 of the counting unit 206.

When the worker shakes the toner cartridge 1, a pulse is generated by the counter 102 every time the spindle 93*b* contacts the contacting points 94, 94 by the swinging of the pendulum 93, and the number of generated pulses is counted. That is, the counting result of the counter 102 corresponds to the shaken number of times of the toner cartridge 1.

Even if the toner in the toner cartridge 1 is coagulated as a result of leaving the toner cartridge 1 untouched for a long period of time, the toner in the toner cartridge 1 is stirred, and the coagulated toner is dissolved by having the worker sufficiently shake the toner cartridge 1 immediately before attaching the toner cartridge 1 to the image forming apparatus 500A body.

The toner cartridge 1 which packaging member P is not removed might be left untouched for a long period of time without being immediately attached to the image forming apparatus 500A even after being sufficiently shaken, in which case the toner in the toner cartridge 1 might coagulate. Thus, the reset switch 100 is turned ON and the pulse is not counted with the counter 102 in the toner cartridge 1 before the packaging member P is removed.

In other words, the counting result of the counter 102 corresponds to the number of times the worker has shaken the toner cartridge 1 immediately before attaching the toner cartridge 1 to the image forming apparatus 500A body. If the shaken number of times is greater than or equal to a predetermined value, the toner in the toner cartridge is assumed to be sufficiently stirred and dissolved.

The worker who has finished shaking the toner cartridge 1 then attaches the toner cartridge 1 to the image forming apparatus 500A body.

If the attachment detection signal is not provided from the attachment detection sensor 208 (NO in S13), the toner cartridge 1 is detached from the image forming apparatus 500A body, and the control unit 28 displays on the display unit 29 a message encouraging the worker to attach the toner cartridge 1 (S14).

After the process of S14 is completed, the control unit 28 determines whether or not the attachment detection signal is provided from the attachment detection sensor 208 (S15), and if the signal is not provided (NO in S15), the process of S15 is repeated since the new toner cartridge 1 is not yet attached to the image forming apparatus 500A. The image obviously cannot be formed in this state.

If the attachment detection signal is provided from the attachment detection sensor 208 (YES in S15), the new toner cartridge 1 is attached to the image forming apparatus 500A body, and thus the control unit 28 acquires the counting result of the counter 102 of the counting unit 206 through the connector 17 (S16), and determines whether or not the acquired counting result is greater than or equal to the predetermined value (S17).

If the counting result obtained from the counter 102 is smaller than the predetermined value (NO in S17), shaking of the toner cartridge 1 is insufficient, and there is a possibility the toner in the toner cartridge 1 is still coagulated, and thus the control unit 28 displays the counting result obtained from the counter 102 and the predetermined value on the display unit 29 (S18), and furthermore, displays a message encouraging the worker to shake the toner cartridge 1 on the display unit 29 as the shaking of the toner cartridge 1 is insufficient (S19), and returns the process to S13. The configuration may be such that in S18 or S19, the difference between the predetermined value and the counting result obtained from the counter 102 is displayed to notify the worker how many more times to shake.

The worker encouraged to shake the toner cartridge 1 once detaches the new toner cartridge 1 just attached to the image forming apparatus 500A body, sufficiently shakes the same, and again attaches the toner cartridge 1 to the image forming apparatus 500A body.

Here, the control unit 28 does not operate the toner conveyance motor 205 and the toner stirring motor 207 until the completion of the processes S20 to S23 to be hereinafter described. The supply of toner from the toner cartridge 1, which is not yet sufficiently shaken, to the developing unit 528 is not executed, and the image is not formed.

Therefore, if the shaking of the toner cartridge 1 is insufficient, the image forming apparatus 500A provides a warning display to the worker, and prohibits the supply of toner from the toner cartridge 1, which is not yet sufficiently shaken, to the developing unit 528, and thus the worker reliably recognizes the necessity to shake the toner cartridge 1. Furthermore, the worker does not need to accurately count the number of times the worker has shaken the toner cartridge 1. How many more times the toner cartridge 1 should be shaken can be recognized by visually checking the counting result and the predetermined value (i.e., number of times the worker has shaken the toner cartridge 1, minimum number of times to shake) displayed on the display unit 29.

If the counting result obtained from the counter 102 is greater than or equal to the predetermined value (YES in S17), the toner cartridge 1 is sufficiently shaken, and the toner in the toner cartridge 1 is dissolved, and thus the control unit 28 displays a message encouraging the worker to remove the seal 21 sealing the toner supply port 27 of the toner cartridge 1 on the display unit 29 (S20).

The worker encouraged to remove the seal 21 removes the seal 21 from the toner cartridge 1 and closes the door of the image forming apparatus 500A body. The opening/closing of the door of the image forming apparatus 500A body is detected by an open/close sensor (not shown), and the detection result is provided to the control unit 28.

After the door of the image forming apparatus 500A body is closed, the control unit 28 drives the toner conveyance motor 205 and the toner stirring motor 207 through the motor drivers 209, 210, respectively (S21). In this case, various rollers 23, 25, 26 rotatably driven by the respective toner conveyance motor 205 and the toner stirring motor 207 are rotated, and the toner is supplied from the toner cartridge 1 to the developing unit 528.

The control unit 28 determines whether or not the toner amount in the developing unit 528 is sufficient based on the detection result of the concentration sensor arranged proximate to the developing unit 528 (S22), and continues the process of S22 if the toner in the developing unit 528 is insufficient (NO in S22). In this case, the rotation of various rollers 23, 25, 26 is continued, and the toner is continuously supplied from the toner cartridge 1 to the developing unit 528.

If the toner amount in the developer 528 is sufficient (YES in S22), the control unit 28 stops (S23) the toner conveyance motor 205 and the toner stirring motor 207 through the motor drivers 209, 210, and returns the process to S11.

According to the execution of the above described toner replenishing process, the toner is replenished to the image forming apparatus 500A, and thereafter, the toner is supplied from the toner cartridge 1 to the photosensitive drum 510 through the developing unit 528, whereby the image is formed.

The reset switch 100 serves as a packaging detection unit.

Second Embodiment

Figure 6:
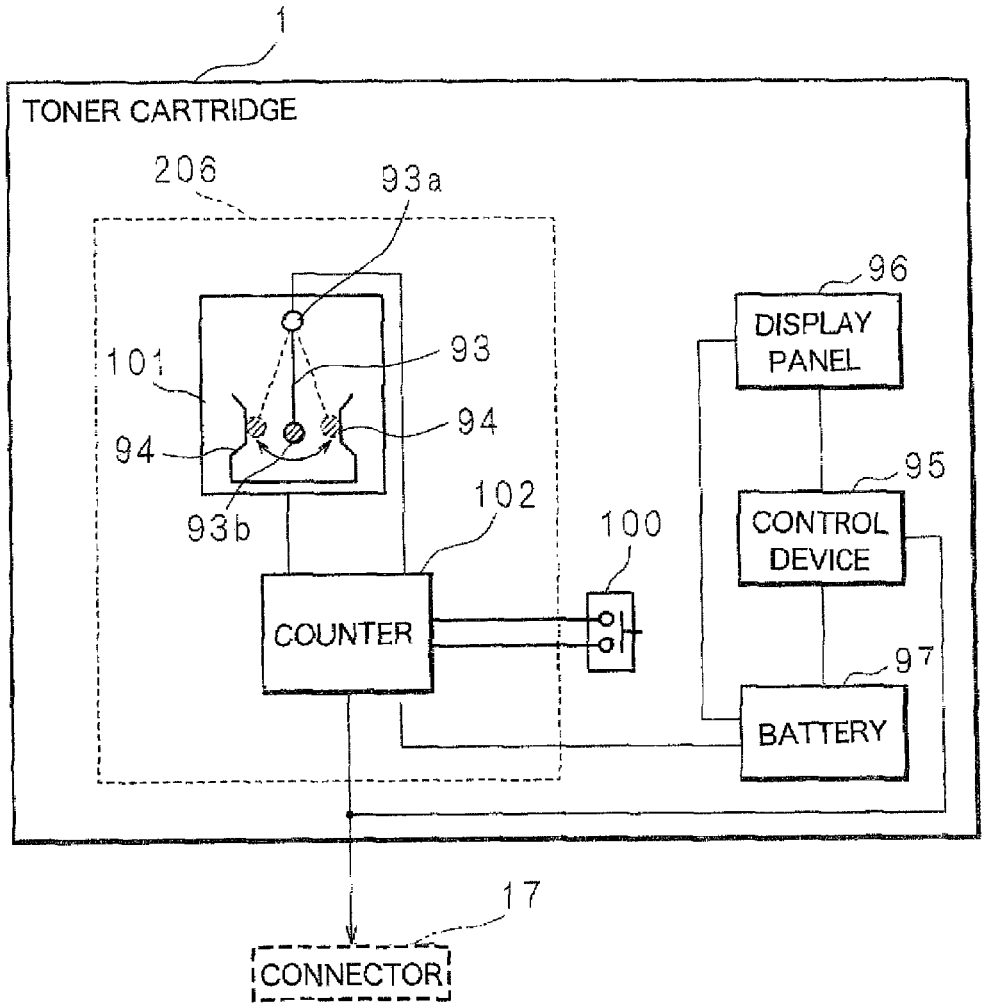
FIG. 6 is a block diagram showing a counting unit arranged in a toner cartridge according to the second embodiment.

FIG. 6 is a block diagram showing a counting unit arranged in a toner cartridge according to the second embodiment. The toner cartridge 1 of the present embodiment further includes a control device 95 and a display panel which operate when the electric power is supplied from the battery 97, different from the toner cartridge 1 of the first embodiment.

Same reference numerals are denoted for portions corresponding to the first embodiment, and the description thereof will be omitted.

The control device 95 integrally includes a CPU, a ROM, a RAM, and an I/O, and the display panel 96 is formed using a liquid crystal panel. The control device 95 controls the display panel 96 to display various messages. The control device 95 is connected to the counter 102.

A predetermined value n0 of the shaken number of times is stored in advance in the ROM of the control device 95, where if the shaken number of times of the toner cartridge 1 is greater than or equal to the predetermined value n0, the toner in the toner cartridge 1 is assumed to be sufficiently stirred and dissolved.

The control device 95 acquires a counting result n of the counter 102, and stores the same in the RAM of the control device 95 as the shaken number of times n1. The counting result n and the shaken number of times n1 are respectively "0" at the time of factory shipment.

Similar to the case of using the toner cartridge 1 of the first embodiment, if the message encouraging to replace the toner cartridge 1 is displayed on the display unit 29 of the image forming apparatus 500A body, the worker opens the door of the image forming apparatus 500A body, detaches the toner cartridge 1 attached to the image forming apparatus 500A body, and prepares a new toner cartridge 1. After removing the packaging member P of the prepared toner cartridge 1, the worker shakes the toner cartridge 1. It should be noted that the seal 21 sealing the toner supply port 27 of the toner cartridge 1 is not yet removed at this point.

The worker who has finished shaking the toner cartridge 1 visually checks the display panel 96 of the toner cartridge 1 before attaching the toner cartridge 1 to the image forming apparatus 500A.

Figure 7:
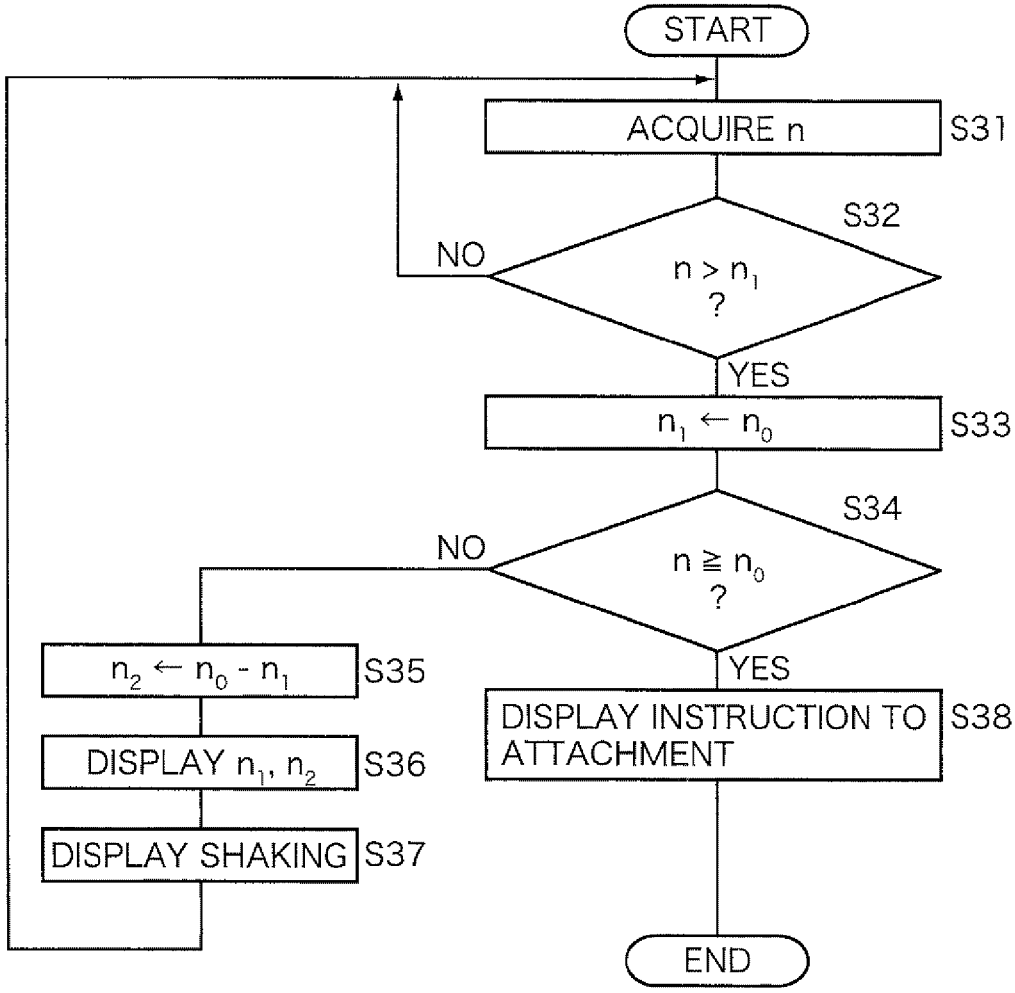
FIG. 7 is a flowchart showing a procedure of the shake supporting process executed by a control device of the toner cartridge according to the second embodiment.

FIG. 7 is a flowchart showing a procedure of the shake supporting process executed by the control device of the toner cartridge according to the second embodiment.

The control device 95 acquires the counting result n of the counter 102 of the counting unit 206 (S31), determines whether or not the acquired counting result n is greater than the shaken number of times n1 stored in the RAM of the control device 95 (S32), and returns the process to S31 if $n \leqq n1$ (NO in S32) since the toner cartridge 1 is not shaken after the completion of the process of the previous S31 or the reset switch 100 is turned ON.

If $n > n1$ (YES in S32), the toner cartridge 1 is shaken after the completion of the process of the previous S31, and thus the control device 95 substitutes the counting result n to the shaken number of times n1 and stores the same in the RAM (S33), and furthermore, determines whether or not the shaken number of times n1 is greater than or equal to the predetermined value n0 stored in the ROM of the control device 95 (S34).

If $n1 < n0$ (NO in S34), the control device 95 calculates the number of times to further shake the toner cartridge 1 (hereinafter referred to as remaining number of times) n2 as the shaken number of times of the toner cartridge 1 is insufficient (S35). Specifically, the control device 95 substitutes the result of subtracting n1 from n0 to the remaining number of times n2 (i.e., $n2 \leftarrow n0 - n1$) and stores the same in the RAM.

The control device 95 then displays the shaken number of times n1 and the remaining number of times n2 on the display panel 96 (S36), displays a message encouraging the worker to shake the toner cartridge 1 since the shaking of the toner cartridge 1 is insufficient on the display panel 96 (S37), and returns the process to S31. In S36, only the remaining number of times n2 may be displayed.

The worker encouraged to shake the toner cartridge 1 further shakes the toner cartridge while referencing the shaken number of times n1 and the remaining number of times n2 displayed on the display panel 96.

Thus, if the shaking of the toner cartridge 1 is insufficient, the toner cartridge 1 provides a warning display to the worker, and the worker recognizes the necessity to shake the toner cartridge 1. Furthermore, the worker does not need to accurately count the number of times the worker has shaken the toner cartridge 1.

If n≧n0 (YES in S34), the toner cartridge 1 is sufficiently shaken, and the toner in the toner cartridge 1 is dissolved, and thus the control device 95 displays a message instructing the worker to attach the toner cartridge 1 to the image forming apparatus 500A body on the display panel 96 (S38), and terminates the shake supporting process.

The worker instructed to attach the toner cartridge 1 to the image forming apparatus 500A body attaches the toner cartridge 1 to the image forming apparatus 500A body, removes the seal 21 sealing the toner supply port 27 of the toner cartridge 1, and closes the door of the image forming apparatus 500A.

After the door of the image forming apparatus 500A body is closed, the control unit 28 of the image forming apparatus 500A drives the toner conveyance motor 205 and the toner stirring motor 207 through the motor drivers 209, 210, respectively. In this case, various rollers 23, 25, 26 rotatably driven by the respective toner conveyance motor 205 and the toner stirring motor 207 are rotated, and the toner is supplied from the toner cartridge 1 to the developing unit 528. That is, the toner is replenished to the image forming apparatus 500A.

The control device 95 of the toner cartridge 1 in the shake supporting process serves as a determining unit, and the display panel 96 serves as a display unit.

When using such toner cartridge 1, the worker recognizes the necessity to shake the toner cartridge 1 before attaching the toner cartridge 1 to the image forming apparatus 500A body. Thus, the trouble of detaching the toner cartridge 1 once attached to the image forming apparatus 500A, and then shaking and reattaching the same when the shaking of the toner cartridge 1 is insufficient is omitted.

Third Embodiment

Figure 8:
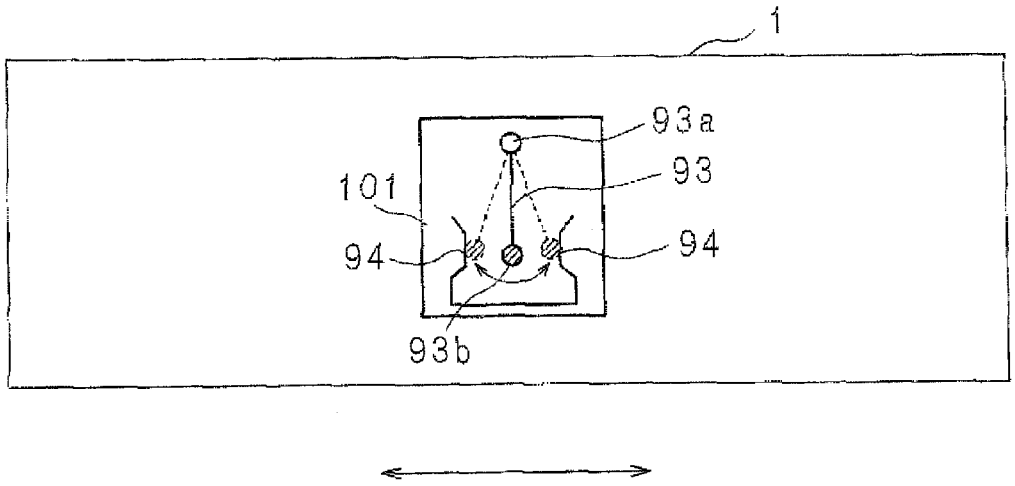
FIG. 8 is a side view showing in frame format a swinging direction of a pendulum arranged in the toner cartridge according to a third embodiment.
Figure 9A:
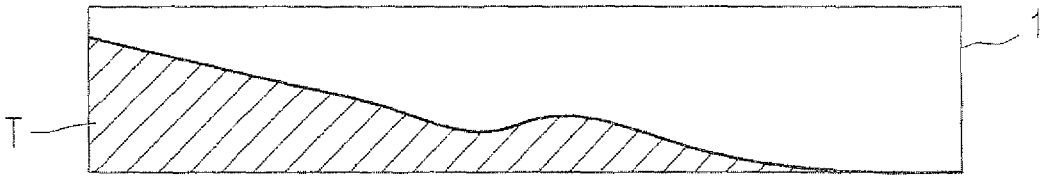
FIGS. 9A and 9B are side views showing in frame format the distribution of the amount of toner contained in the toner cartridge according to the third embodiment.
Figure 9B:
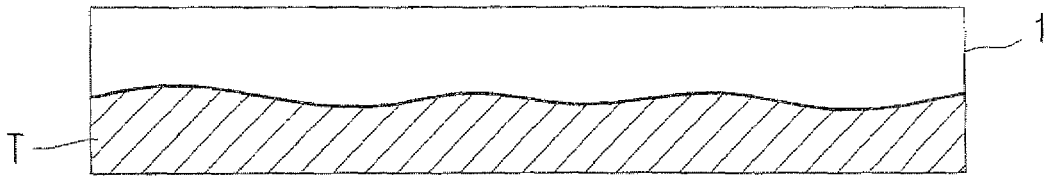

FIG. 8 is a side view showing in frame format a swinging direction of the pendulum arranged in the toner cartridge according to the third embodiment, and FIGS. 9A and 9B are a side view showing in frame format the distribution of the amount of toner contained in the relevant toner cartridge.

The toner cartridge 1 of the present embodiment has a configuration substantially similar to the toner cartridge 1 of the first and the second embodiments, but the pendulum 93 swings in a direction along a longitudinal direction (In FIG. 8, direction of arrow, hereinafter simply referred to as longitudinal direction) of the toner cartridge 1, and the two contacting points 94, 94 are arranged spaced apart in the longitudinal direction, as shown in FIG. 8.

More specifically, the pendulum 93 has the spindle 93*b* suspended from the supporting point 93*a* reciprocating in the direction along the longitudinal direction with the supporting point 93*a* as the center to alternately contact the contacting points 94, 94. The guiding part for guiding the swinging of the spindle 93*b* so that the reciprocation of the spindle 93*b* is limited to the direction along the longitudinal direction may be arranged in the pendulum unit 101.

Same reference numerals are denoted for portions corresponding to the first and the second embodiments, and the description thereof will be omitted.

Since the contacting points 94, 94 are arranged spaced apart in the longitudinal direction, when the worker shakes the toner cartridge 1 in the longitudinal direction so that the pendulum 93 swings in the direction along the longitudinal direction even if the pendulum 93 can be swung in a plurality of directions, the spindle 93*b* contacts the contacting point 94 and the shaken number of times of the toner cartridge 1 is counted. The counting result of the counter 102 is barely incremented even if the toner cartridge 1 is shaken in a direction other than the longitudinal direction (e.g., direction orthogonal to longitudinal direction).

In the toner cartridge 1, the distribution of the toner amount in the longitudinal direction of the contained toner T is sometimes uneven, as shown in FIG. 9A. If the distribution of the toner amount in the longitudinal direction is uneven, the toner amount sensor 24 may not accurately detect the remaining amount of toner in the toner container 22 or the distribution of the toner amount in the longitudinal direction of the toner T supplied from the toner cartridge 1 to the developing unit 528 may become uneven, whereby the quality of the image formed on the recording sheet S may degrade. The toner cartridge 1 needs to be shaken in the longitudinal direction to suppress such drawback.

When the worker shakes the toner cartridge 1 in the longitudinal direction and the shaken number of times becomes greater than or equal to the predetermined value, the distribution of the toner amount in the longitudinal direction of the toner T contained in the toner cartridge 1 becomes even, as shown in FIG. 9B.

Fourth Embodiment

Figure 10:
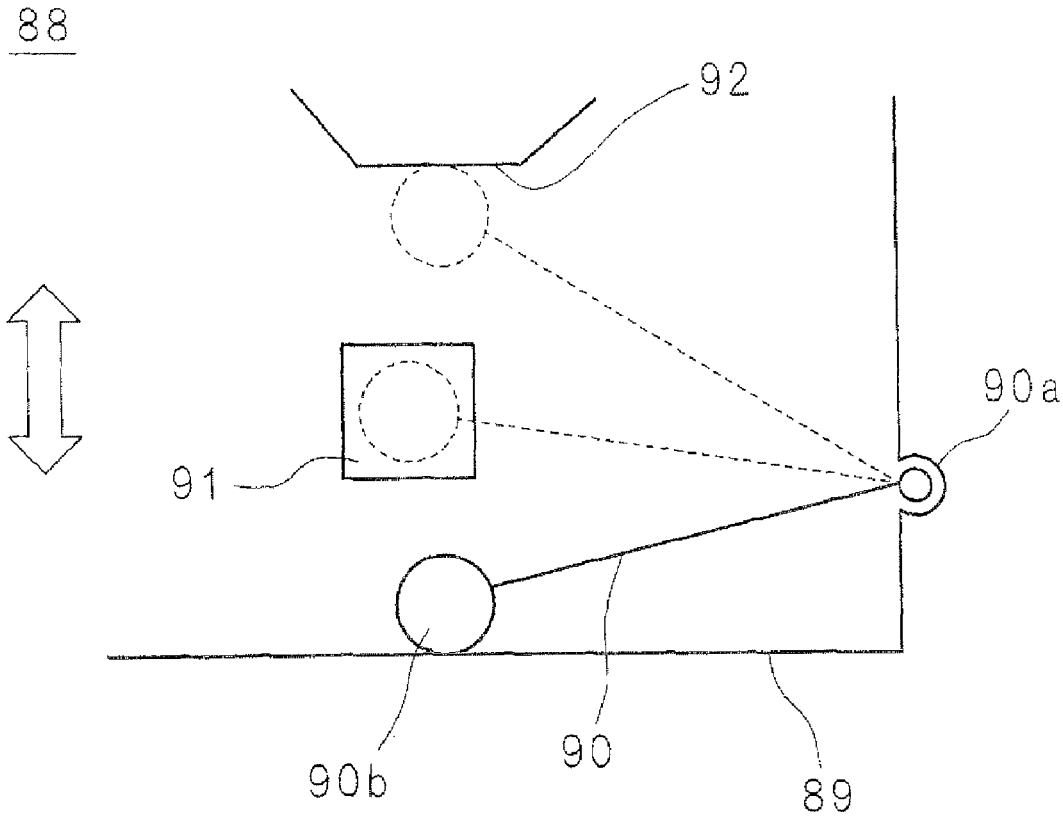
FIG. 10 is a front view showing a configuration of a pendulum unit arranged in a toner cartridge according to a fourth embodiment.
Figure 11:
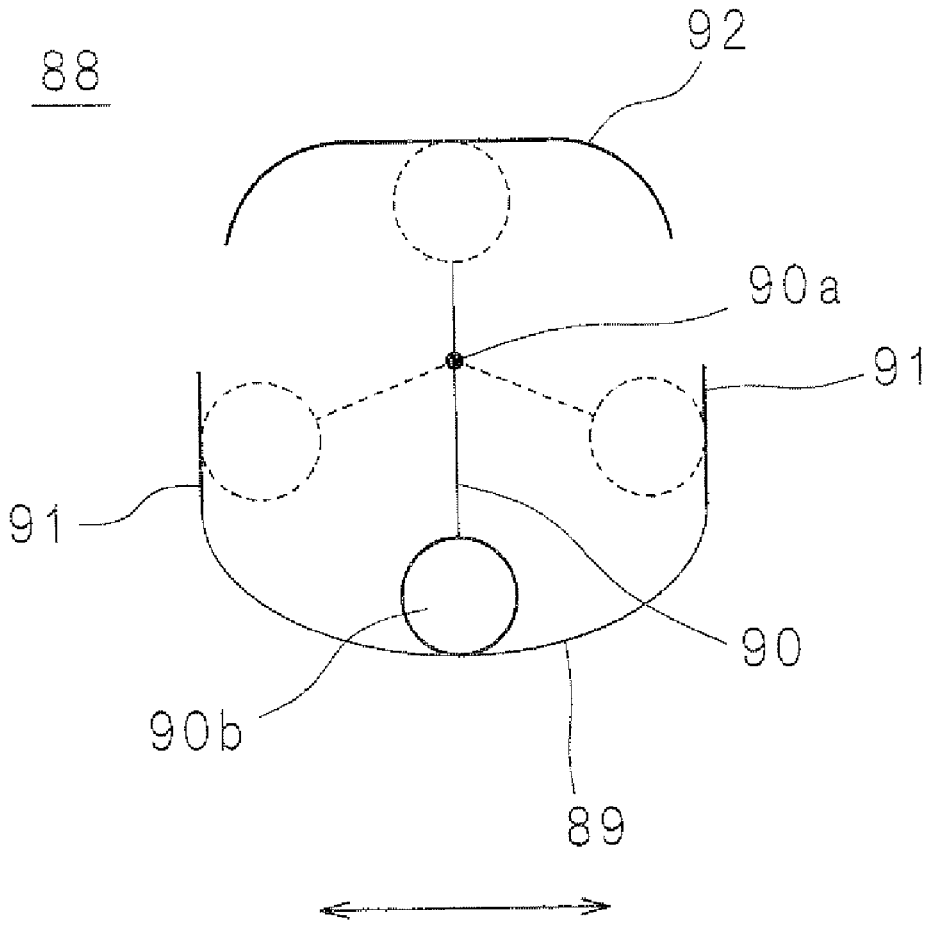
FIG. 11 is a side view showing a configuration of the pendulum unit arranged in the toner cartridge according to the fourth embodiment.

FIG. 10 is a front view showing a configuration of a pendulum unit arranged in a toner cartridge according to a fourth embodiment, and FIG. 11 is a side view showing a configuration of the pendulum unit arranged in the toner cartridge according to the fourth embodiment.

The toner cartridge 1 of the present embodiment has a configuration substantially similar to the toner cartridge 1 of the first and the second embodiments, but includes a pendulum unit 88 in place of the pendulum unit 101 of the first and the second embodiments.

Same references are denoted for the portions corresponding to the first and the second embodiments, and the description thereof will be omitted.

As described in the third embodiment, since the distribution of the toner amount in the longitudinal direction (direction of arrow in FIG. 11) of the containing toner sometimes becomes uneven in the toner cartridge 1, the toner cartridge 1 needs to be shaken in the longitudinal direction.

As the toner condenses by its own weight, it needs to be shaken in the up and down direction (direction of outline arrow in FIG. 10).

Therefore, the worker shakes the toner cartridge 1 in the longitudinal direction as well as in the up and down direction, The pendulum unit 88 is configured by a pendulum 90 that swings in a plurality of directions, and contacting points 91, 91, 92 arranged in correspondence to the respective swinging directions of the pendulum 90.

The pendulum 90 has a spindle 90*b* reciprocating in the longitudinal direction with a supporting point 90*a* as a center to alternately contact the contacting points 91, 91, and reciprocating in the up and down direction to contact the contacting point 92 arranged on the upper side and a receiving tray 89 arranged on the lower side. The receiving tray 89 serves as a guiding part for guiding the swing in the longitudinal direction of the pendulum 90.

The pendulum 90 and the contacting points 91, 91, 92 respectively have electrical conductivity, where the supporting point 90*a* and the contacting points 91, 91 are connected to the counter 102, and the supporting point 90*a* and the contacting point 91 or contacting point 92 become electrically conductive when the spindle 90*b* contacts one of the contacting point 91 or the contacting point 92.

The counter 102 generates a pulse when the reset switch 100 is turned OFF and the supporting point 90*a* and the contacting point 91 or the contacting point 92 are electrically conducted, and counts the generated pulse. Therefore, the counting result of the counter 102 corresponds to the number of times the toner cartridge 1 has been shaken in the up and down direction and in the longitudinal direction. If the counting result of the counter 102 is greater than or equal to the predetermined value, the distribution of the toner amount in the longitudinal direction becomes even, and the toner is assumed to be sufficiently stirred and dissolved.

The shaken number of times in the up and down direction and the shaken number of times in the longitudinal direction may be individually counted, and determination on whether or not each counting result is greater than or equal to the predetermined value may be made.

Fifth Embodiment

In the first to the fourth embodiments, the toner cartridge 1 is configured to be removably attached to the developing unit 528, but a toner replenishing device for replenishing toner of an appropriate amount as necessary may be arranged in the developing unit 528, and the toner cartridge may be attached to the toner replenishing device.

Figure 12:
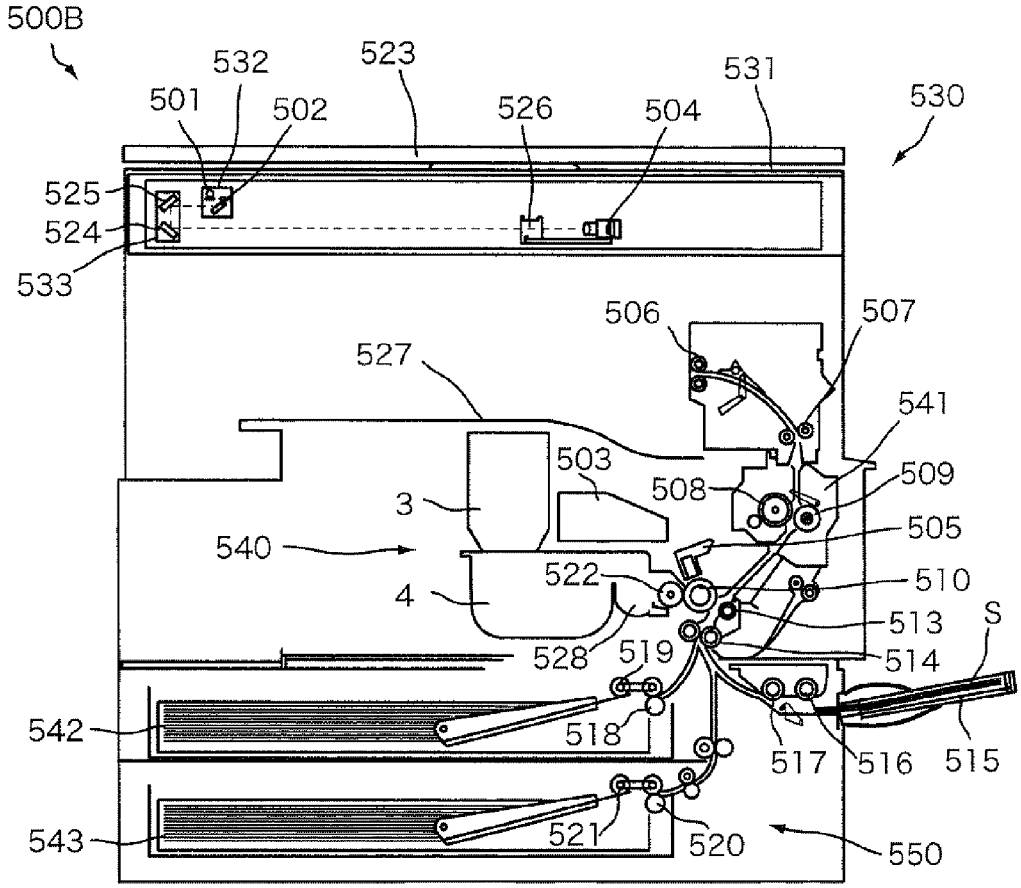
FIG. 12 is a front view showing an internal configuration of an image forming apparatus according to a fifth embodiment.

FIG. 12 is a front view showing an internal configuration of an image forming apparatus according to a fifth embodiment. The image forming apparatus 500B according to the present embodiment is substantially the same as the image forming apparatus 500A shown in FIG. 1. In FIG. 12, same reference numerals are denoted for the components same as in the image forming apparatus 500A, and the description thereof will be omitted.

A toner replenishing device 4 is connected to the developing unit 528 of the image forming apparatus 500B. A predetermined amount of toner is contained in the toner replenishing device 4. The toner in the toner replenishing device 4 is stirred, and the appropriate amount of toner is replenished to the developing unit 528 as necessary. If the toner in the toner replenishing device 4 decreases due to printing and the like, a toner cartridge 3 is attached to the toner replenishing device 4 to refill the toner. FIG. 12 shows a state in which the toner cartridge 3 is attached to the toner replenishing device 4.

Figure 13:
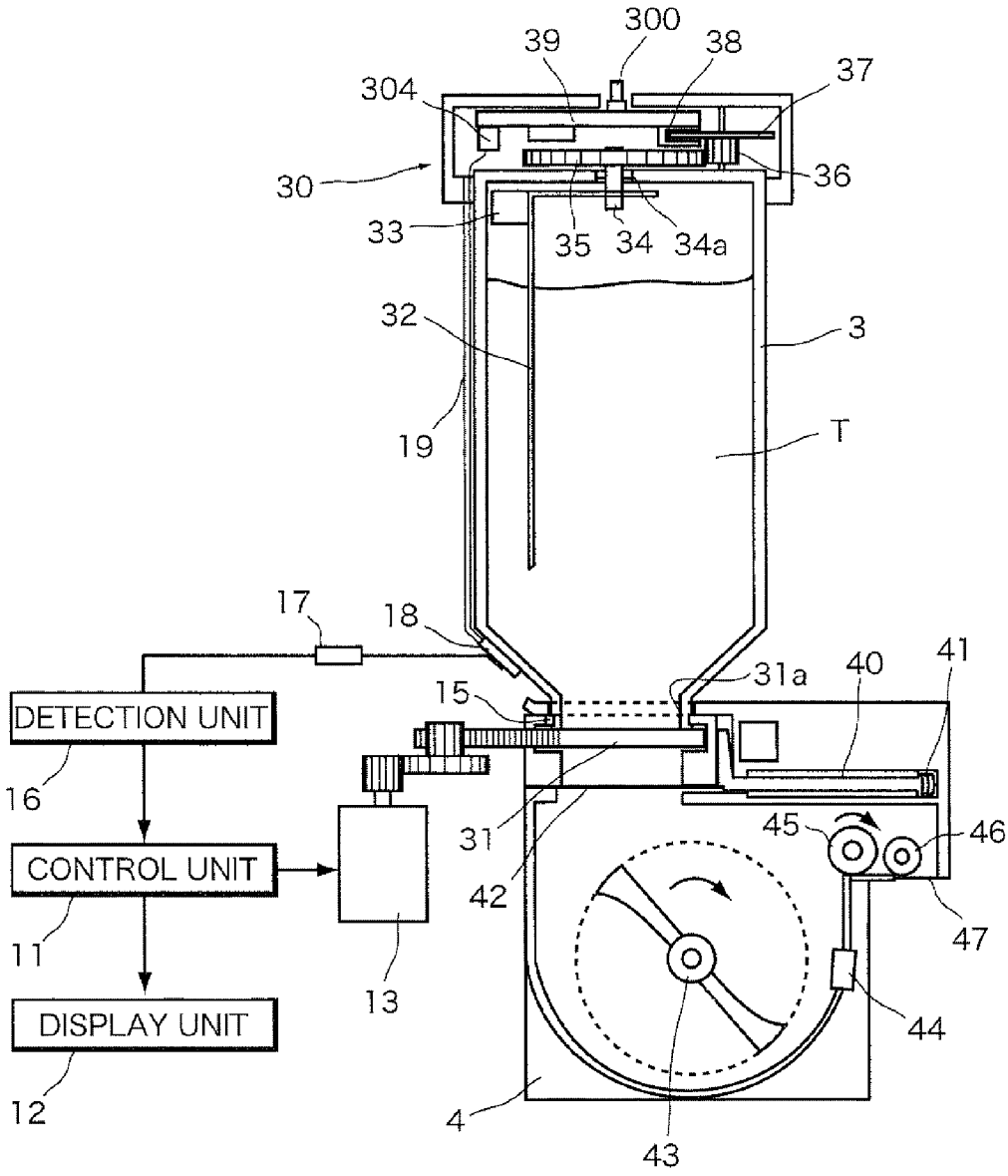
FIG. 13 is a frame format view showing a configuration of a toner replenishing device for replenishing toner to a developing unit.

FIG. 13 is a frame format view showing a configuration of the toner replenishing device 4 for replenishing the toner to the developing unit 528. The image forming apparatus 500B according to the present embodiment includes the toner replenishing device 4 to replenish the toner to the developing unit 528. The toner replenishing device 4 is attached with the toner cartridge 3 by the worker when the toner consumption advances due to printing and the toner therein decreases. The toner cartridge 3 is attached to the toner replenishing device 4 only when replenishing the toner, and is normally not attached when forming an image.

The toner replenishing device 4 is formed with a toner take-in port 42 that opens when the toner replenishing port 31*a* of the toner cartridge 3 is fitted into the upper surface part and pushed in horizontally. When the toner cartridge 3 is not attached to the toner replenishing device 4, a toner replenishing shutter 40 that closes by the repulsive force of a shutter spring 41 so as to block the toner take-in port 42 to prevent foreign substances from mixing inside the toner replenishing device 4, and that opens the toner take-in port 42 by being pushed in by the toner replenishing port 31*a* of the toner cartridge 3 when the tone cartridge 3 is attached is arranged.

The toner replenishing device 4 includes a toner amount sensor 44 for measuring the remaining amount of toner, a stirring roller 43 for stirring the toner replenished by the toner cartridge 3, a conveyance roller 45 for conveying the toner from the stirring unit to the discharge unit, and a discharge roller 46 for discharging the conveyed toner to the developing unit 528, and stirs and charges the toner replenished by the toner cartridge 3 through the rotating operation of each roller, and sends an appropriate amount of toner from the toner supply port 47 to the developing unit 528 as necessary.

The toner cartridge 3 is a substantially cylindrical container having an electric power generation unit 30 on the upper attachment surface, and a replenishing port 31*a* for refilling the toner T filled inside the cartridge to the toner replenishing device 4 on the lower attachment surface, where a replenishing valve 31 which operates by the drive from the image forming apparatus 500B is arranged at the replenishing port 31*a* so as to open/close the replenishing port 31*a*.

The toner T filled in the toner cartridge 3 is set to an amount of an extent a space can be ensured inside the toner cartridge 3 with a slight margin with respect to the internal volume of the toner cartridge 3.

A toner stirring member 32 and an eccentric spindle 33 are arranged inside the toner cartridge 3. The toner stirring member 32 has the cross section formed to a substantially L-shape, where the supporting part of the short end face bent to a substantially L-shape is fixed to a rotation shaft 34 arranged at the center of the cylinder of the toner cartridge 3. The rotation shaft 34 passes through the toner cartridge 3, and supports a rotation gear 35 at the outer side of the toner cartridge 3 and on the inner side of the electric power generation unit 30. The rotation shaft 34 is supported such that the toner stirring member 32 and the eccentric spindle 33 rotatably operate with the rotation shaft 34 as the center by a bearing 34*a* shielded so as to prevent leakage of toner T filled inside the toner cartridge 3 with respect to the toner cartridge 3.

A driven gear 36 is supported so as to couple and gear with the rotation gear 35 inside the electric power generation unit 30. The number of teeth of the driven gear 36 is less than that of the rotation gear 35, and a rotation of the number of teeth ratio multiples of the rotation gear 35 and the driven gear 36 is obtained at the driven gear 36 with respect to the rotating operation of the rotation gear 35. The driven gear 36 coaxially supports a permanent magnet 37, in which the S pole and the N pole are respectively formed at diagonal positions, so as to rotation operate according to the operation of the driven gear 36. An induction coil 38 is arranged near the rotation circumference of the permanent magnet 37, and is electrically connected and supported by an electric power generation unit substrate 39 supported by the electric power generation unit 30.

A contacting point 18 with a conductor contact part 17 having spring property to be electrically connected with the detection unit 16 on the image forming apparatus 500B side is arranged in the vicinity of the replenishing port 31*a* of the toner cartridge 3, and a conductor 19 is connected between the output of the electric power generation unit substrate 39 and the contacting point 18 along the side surface of the toner cartridge, thereby configuring a connection circuit to guide the output voltage of the electric power generation unit substrate 39 to the detection unit 16 on the image forming apparatus 500B side.

The conductor contact part 17 and the contacting point 18 are structures respectively having contacting points of two poles, the two poles being insulated and not short circuiting, where the (+) potential side and (−) potential side of the electric power generation unit substrate output are connected thereto by the conductor 19. The detection result of the detection unit 16 is transmitted to the control unit 11, and the control unit 11 drives the toner replenishing valve open/close motor 13 arranged by being fitted to the display unit 12 or the toner cartridge replenish valve 31 arranged in the image forming apparatus 500B according to the detection result of the detection unit 16.

Figure 14:
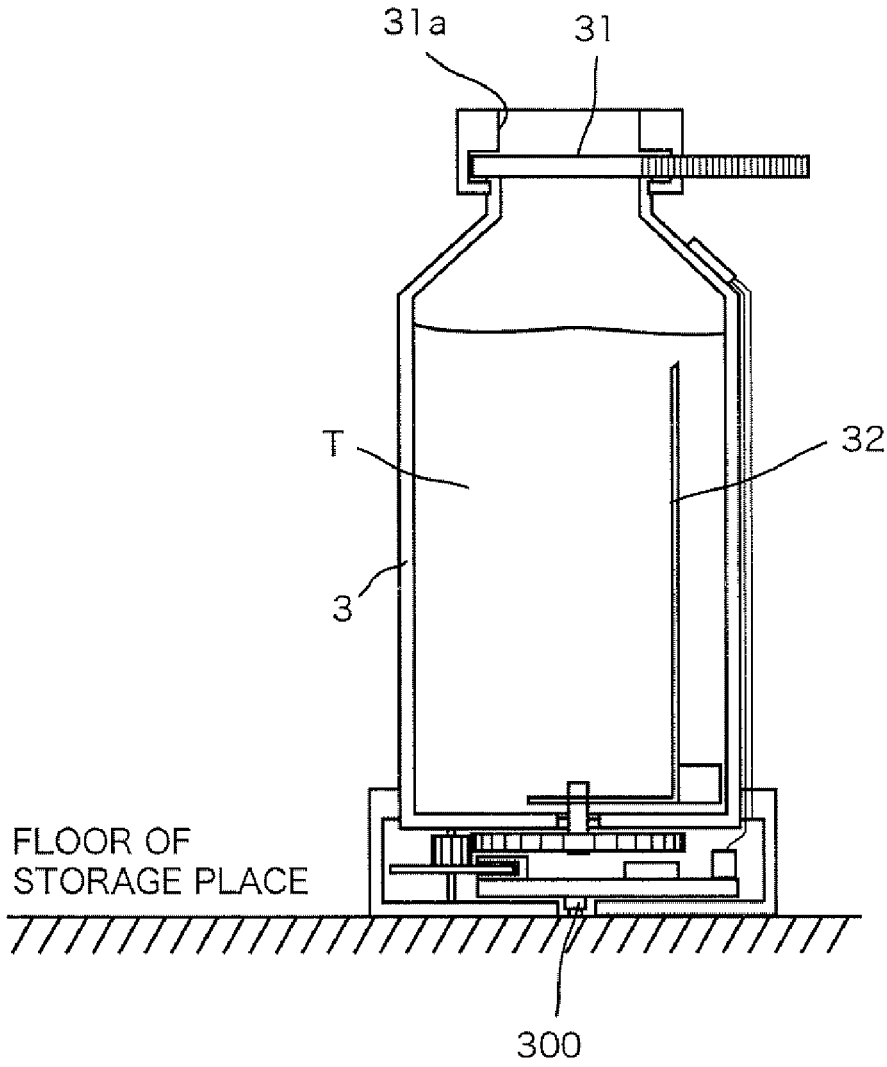
FIG. 14 is a frame format view showing a state of the toner cartridge in the stored state.
Figure 15:
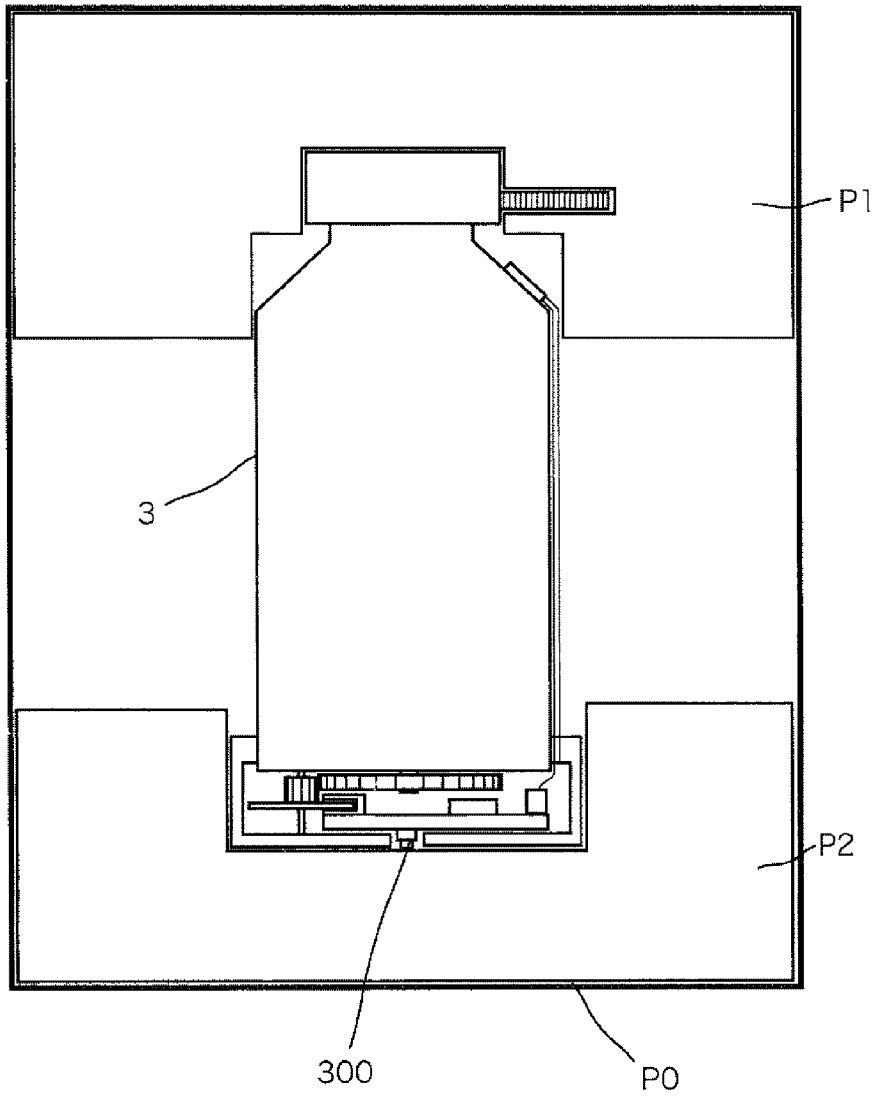
FIG. 15 is a frame format view showing a state of the toner cartridge in the packaged state.

A push switch 300 having an operation part that freely advances and retreats to and from the cartridge housing is arranged on the electric power generation unit substrate 39. The push switch 300 is configured to contact the contacting point when the operation part is pushed in. FIGS. 14 and 15 are frame format views showing the state of the toner cartridge 3 in the stored state and the packaged state. As shown in FIG. 14, the operation part of the push switch 300 is pushed by the floor of the storage place in the stored state. Similarly, in package transportation, the operation part of the push switch 300 is pushed in by the packaging materials P1, P2 protecting and fixing the toner cartridge 3 in a package box P0 as shown in FIG. 15.

As shown in FIG. 14, the toner cartridge 3 is placed with toner replenishing port 31*a* on the upper side in time of storage, but if left untouched for a long period of time, the toner in the toner cartridge 3 coagulates. The toner is known to exhibit behavior close to solid when coagulated but exhibit behavior close to liquid in a sufficiently dissolved state, and thus the coagulated toner needs to be dissolved to obtain the original property, in particular, fluidity of the toner in order to refill the toner replenishing device 4 with the toner T in the toner cartridge 3.

The attachment worker of the toner cartridge 3 performs a task of shaking the toner cartridge 3 in the up and down, and left and right directions as a task before attaching the toner cartridge 3 to the toner replenishing device 4. The stirring member 32 and the eccentric spindle 33 inside the toner cartridge 33 rotation operate with the rotation shaft 34 with which they are supported as the center by the inertia generated from the shaking. The coagulated toner gradually dissolves by the rotation of the stirring member 32, thereby returning the toner T to the particle state to obtain a satisfactory fluidity. However, since the shaking task of the toner cartridge 3 is mainly carried out by human power, the shaking may be insufficient or the shaking work might not be carried out, and thus whether or not shaking has been sufficiently carried out needs to be checked.

In the present embodiment, in order to detect whether or not sufficient shaking task has been carried out before attachment to the toner replenishing device 4, the toner cartridge 3 includes the electric power generation unit 30 for generating electric power from the shaking of the toner cartridge 3, and the image forming apparatus 500B includes a toner cartridge attachment detecting sensor 15 for detecting the attachment of the toner cartridge 3, the detection unit 16 for detecting the stirring amount of the toner with the electric power generated amount of the electric power generation unit 30, the display unit 12 controlled by the control unit 11, the toner replenishing valve open/close motor 13 for driving the replenishing valve 31 of the toner cartridge 3, and the like (see FIG. 13).

Figure 16:
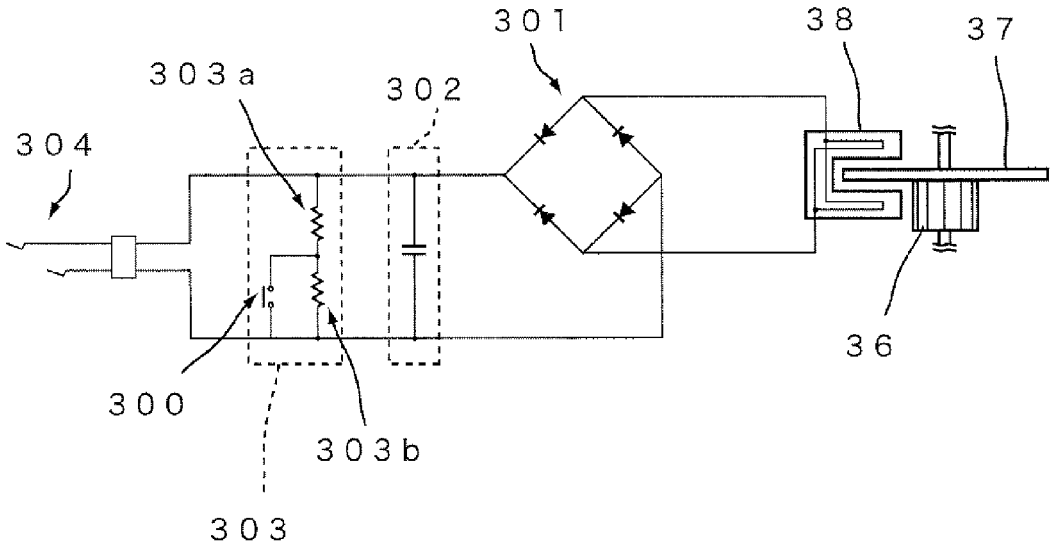
FIG. 16 is a circuit diagram showing a configuration of an electric power generation unit.

The method of detecting the shaken amount of the toner cartridge 3 will be described. FIG. 16 is a circuit diagram showing a configuration of the electric power generation unit 30. In the present embodiment, the rotation gear 35 is rotated using the inertia generated in the stirring member 32 and the eccentric spindle 33 by the shaking task, and the driven gear 36 with less number of teeth than the rotation gear 35 is geared thereto, so that the rotation of the number of teeth ratio multiples of the rotation gear 35 and the driven gear 36 is obtained in the driven gear 36 with respect to the rotating operation of the rotation gear 35.

The permanent magnet 37 is fixed to the driven gear 36, and the induction coil 38 is arranged so as to be proximate to the permanent magnet 37, and thus the rotating operation generated by the inertia from the shaking becomes the rotation of the number of teeth ratio multiples of the rotation gear 35 and the driven gear 36, and the magnetic field in which the induction coil 38 is arranged can be inversion changed at high speed. An electromotive force due to electromagnetic induction is generated at the induction coil 38. The electric power obtained from the electromotive force is proportional to the speed and the number of times for the change in magnetic field, and thus the rotation number of the rotation gear 35, that is, the presence and the shaking amount (shaken number of times) of the shaking task can be detected from the magnitude of the obtained electric power.

The power obtained by the induction coil 38 appears as an AC waveform due to the induction obtained in the rotating magnetic field by the rotation of the permanent magnet. The waveform is converted to a full-wave waveform by a rectifying circuit 301 configured by a diode bridge, and charges a storage circuit 302 configured by a capacitor. A discharge circuit 303 and a connector terminal 304 on which the charging voltage of the storage circuit 302 appears are connected in parallel to the storage circuit 302.

The discharge circuit 303 is configured by the push switch 300, a switch protection resistor 303*a* of a discharge constant of within a few minutes with respect to the capacitor capacity of the storage circuit 302, and a discharge resistor 303*b* of discharge constant of about a few dozen minutes to a few hours with respect to the storage circuit 302. The discharge circuit 303 is configured to discharge the unnecessary electric power generated by vibration etc. during transportation within a few minutes when the toner cartridge 3 is in the storage installed state (FIG. 14) or the packaged state (FIG. 15). If left untouched for a long period time with sufficient charges stored in the storage circuit 302 by the shaking task of the toner cartridge 3 after the packaged state is resolved (i.e., after the push switch 300 is released), the toner in the toner cartridge 3 again coagulates, and the shaking task again needs to be encouraged before replenishing toner, and thus the discharge circuit is configured to discharge the charges stored in the storage circuit 302 between a few dozen minutes to a few hours.

Figure 17:
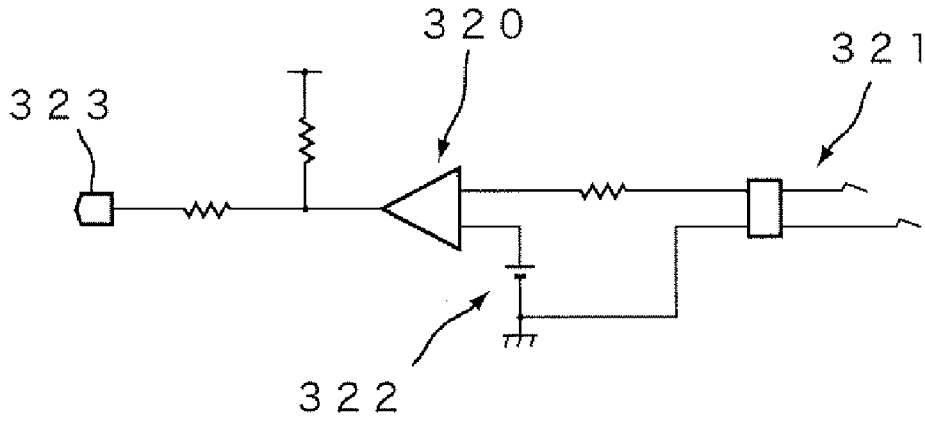
FIG. 17 is a circuit diagram showing a circuit configuration of a detection unit.

In the image forming apparatus 500B side, the charging voltage of the storage circuit 302 of the toner cartridge 3 is acquired by the conductor contact part 17 shown in FIG. 12, and judged by the detection unit 16. FIG. 17 is a circuit diagram showing a circuit configuration of the detection unit 16. The detection unit 16 includes a comparison circuit 320, compares the charging voltage of the storage circuit 302 acquired by the connecting contacting point 321 and the comparison reference voltage obtained by the reference electric power supply 322 in the detection circuit, determines whether the charging voltage is higher than the comparison reference voltage, and transmits the detection result to the control unit 11 shown in FIG. 12 from the output terminal 323.

Figure 18:
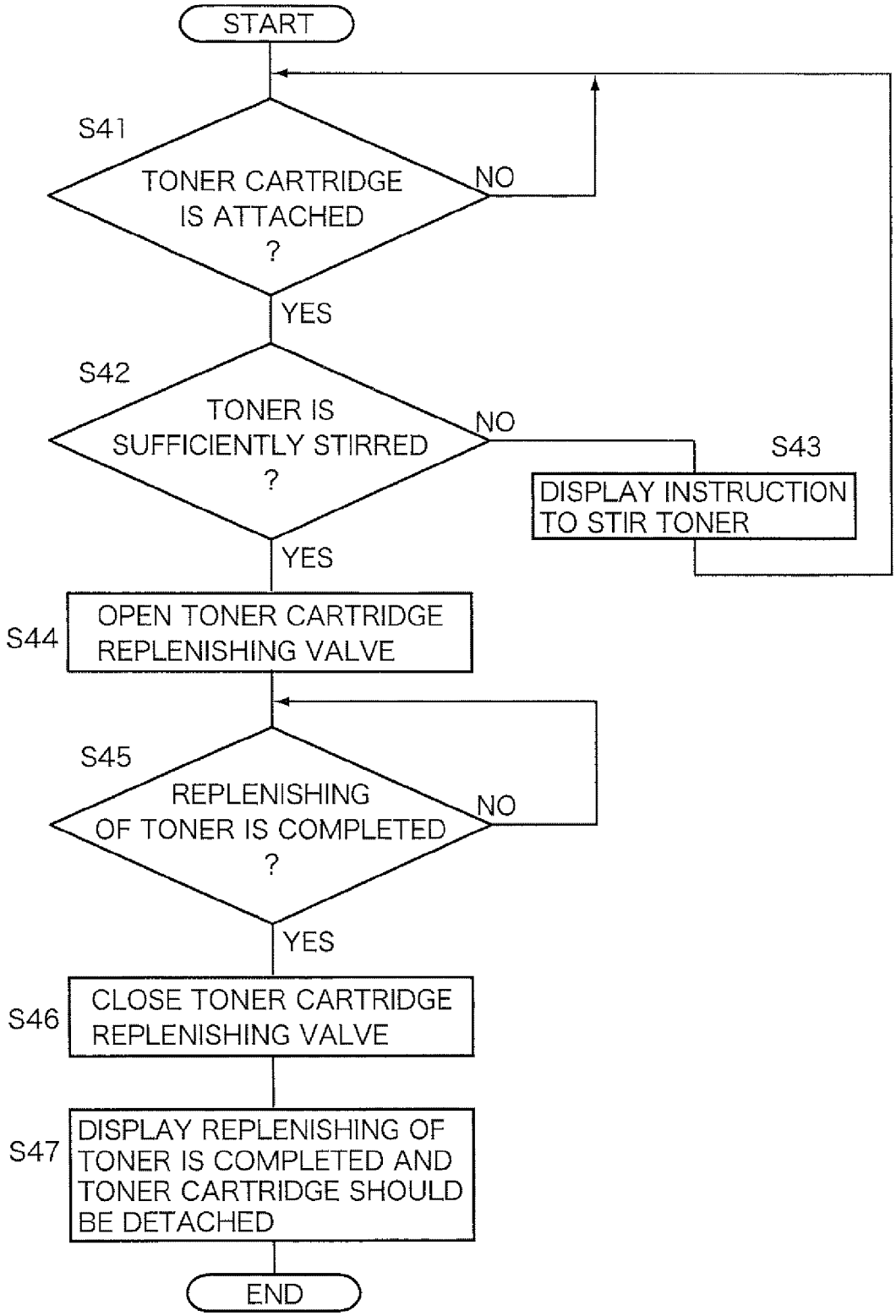
FIG. 18 is a flowchart showing a procedure of processes executed by the image forming apparatus when replenishing toner.

The operation in time of toner replenishing will be described below. FIG. 18 is a flowchart showing a procedure of processes executed by the image forming apparatus 500B when replenishing toner. The control unit 11 of the image forming apparatus 500B determines whether or not the toner cartridge 3 is attached based on the output of the toner cartridge attachment detection sensor 15 arranged at the replenishing port 31*a* of the toner replenishing device 4 (step S41). If determined that the toner cartridge 3 is not attached (S41: NO), the process waits until the toner cartridge 3 is attached.

If determined that the toner cartridge 3 is attached based on the output of the toner cartridge attachment detection sensor 15 (S41: YES), the control unit 11 determines whether or not the toner inside is sufficiently stirred by the shaking of the toner cartridge 3 based on the detection result from the detection unit 16 (step S42). If determined that the toner is not sufficiently stirred (S42: NO), that is, if the charging voltage of the storage circuit 302 is lower than the comparison reference voltage and the detection result indicating that electric power generated amount by the electric power generation unit 30 is not sufficient is notified by the detection unit 16, the control unit 11 controls the display unit 12 to display an instruction to stir the toner on the display unit 12 (step S43).

If determined that the toner is sufficiently stirred (S42: YES), that is, if the charging voltage of the storage circuit 302 is greater than or equal to the comparison reference voltage, and the detection result indicating that the electric power generated amount by the electric power generation unit 30 is sufficient is notified by the detection unit 16, the control unit 11 drive controls the toner replenishing valve open/close motor 13 and opens the toner cartridge replenishing valve 31 (step S44).

The control unit 11 then determines whether or not the replenishing of toner is completed (step S45). The determination on whether or not the replenishing of toner is completed is made by determining whether or not a predetermined time has elapsed from the start of replenishing of the toner. If determined that the replenishing of toner is not completed (S45: NO), the process waits until the replenishing of toner is completed.

If determined that the replenishing of toner is completed (S45: YES), the control unit 11 drive controls the toner replenishing valve open/close motor 13 and closes the toner cartridge replenishing valve 31 (step S46). The notification that the replenishing of toner is completed and the notification that the toner cartridge 3 should be detached are displayed on the display unit 12 (step S47), and the toner replenishing operation according to this flowchart is terminated.

In the present embodiment, a configuration of encouraging the shaking of the toner cartridge 3 through display on the display unit 12 when determined that the toner cartridge 3 is not sufficiently stirred has been adopted, but an output means such as for voice etc. may be arranged to notify such notification through voice output.

Sixth Embodiment

In the fifth embodiment, a configuration of detecting whether or not the toner cartridge 3 is attached with the toner T therein sufficiently stirred after being attached to the toner replenishing device 4, and displaying a notification that the toner cartridge 3 needs to be shaken again on the display unit 12 of the image forming apparatus 500B if determined that the toner is not sufficiently stirred is adopted, but a display unit may be arranged on the toner cartridge 3 itself to display the notification on the relevant display unit.

Figure 19:
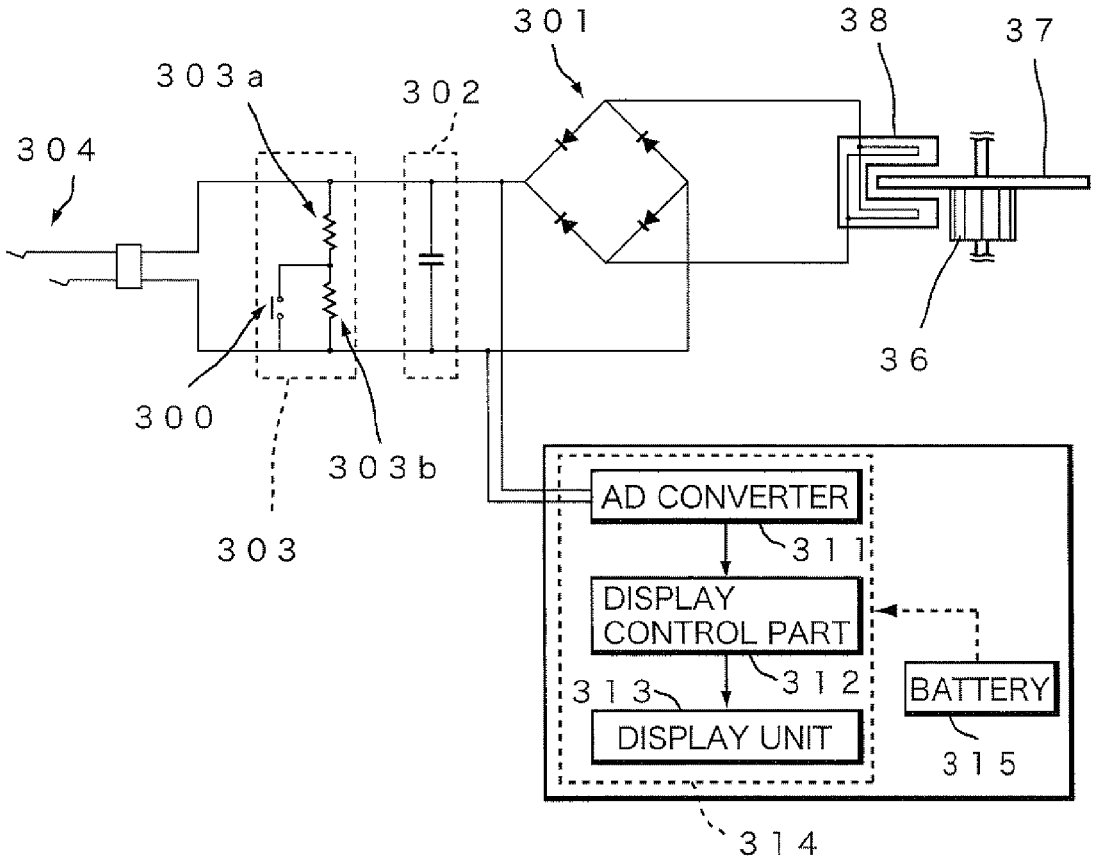
FIG. 19 is a circuit diagram showing a circuit configuration of a toner cartridge according to a sixth embodiment.

FIG. 19 is a circuit diagram showing a configuration of the toner cartridge according to the sixth embodiment. The toner cartridge according to the present embodiment includes a display unit 314 including an AD converter 311, a display control part 312, and a display panel 313, and a battery 315 for supplying electric power to the display unit 314 to display the shaking amount.

The voltage of both ends of the storage circuit 302 described in the fifth embodiment is converted in the AD converter 311 and output to the display control part 312. The display control part 312 is a one-chip CPU including CPU, ROM, RAM, I/O and the like (not shown). The display control part 312 displays, on the display panel 313, the value corresponding to the difference between the voltage at both ends and the voltage at both ends that becomes a reference (voltage corresponding to the shaking amount necessary in performing the toner replenishing task), or the shaken number of times based on the AD converted value. The worker performing the toner replenishing task can recognize how much more shaking is necessary by referencing the current display, and can perform the shaking task until the required shaking amount is reached.

Seventh Embodiment

The electric power generation unit 30 in the fifth embodiment is configured with an electric power generator/motor, where electric power is supplied to the electric power generator/motor from the main body to operate the toner stirring member 32 and stir the toner.

Figure 20:
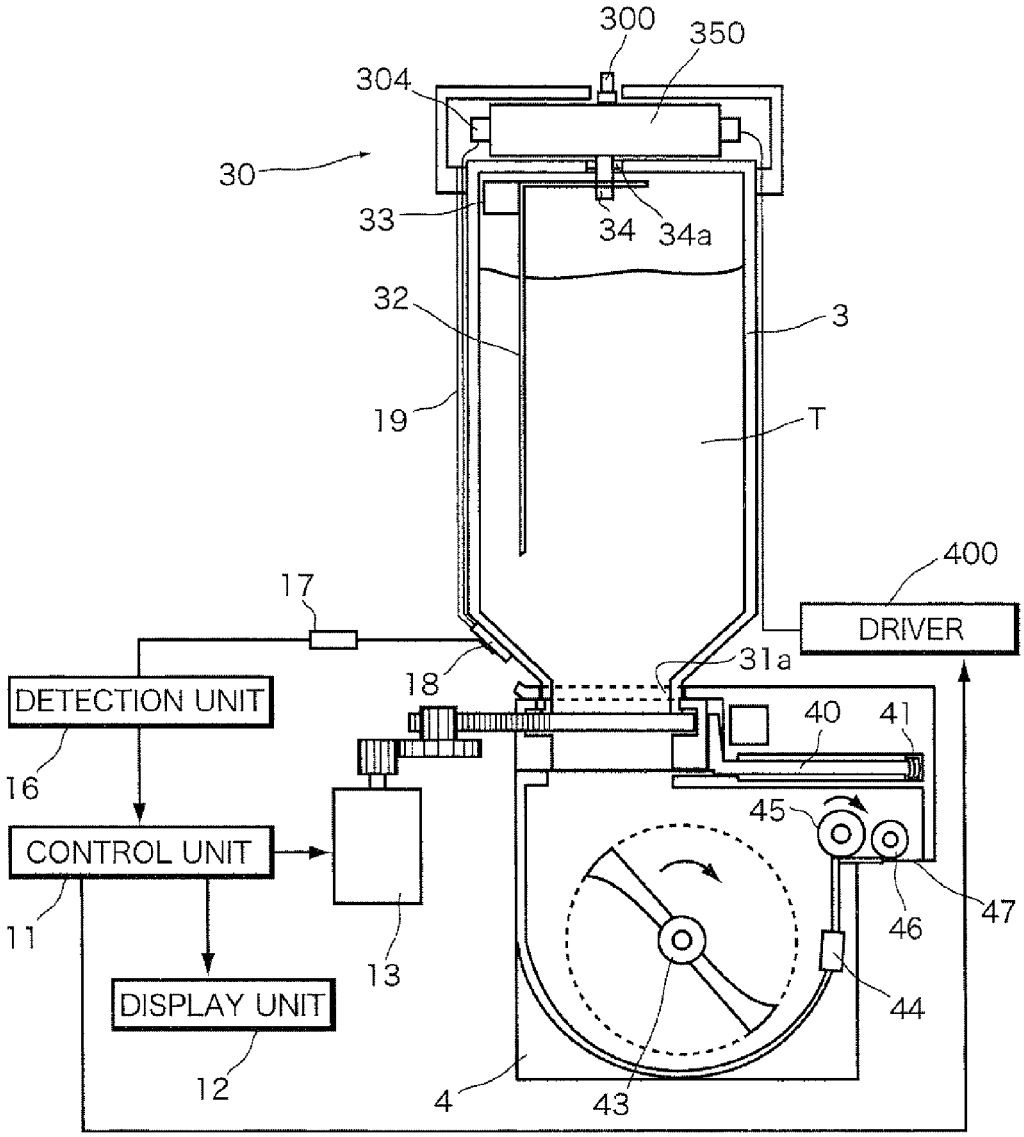
FIG. 20 is a frame format view showing a configuration of a toner replenishing device according to a seventh embodiment.
Figure 21:
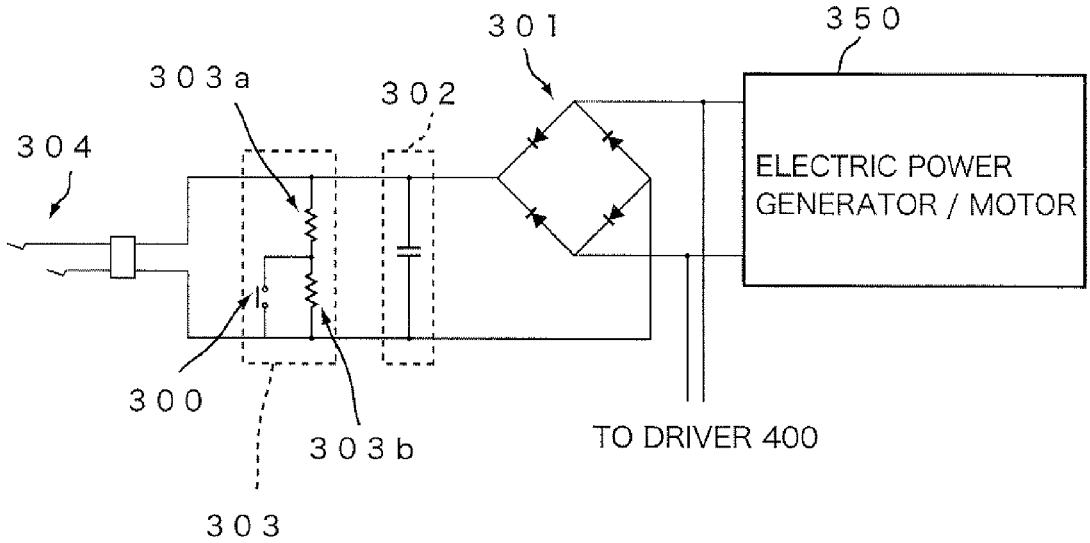
FIG. 21 is a circuit diagram showing a circuit configuration of an electric power generation circuit.

FIG. 20 is a frame format view showing a configuration of the toner replenishing device 4 according to the seventh embodiment, and FIG. 21 is a circuit diagram showing a circuit configuration of the electric power generating circuit. In the figure, 350 denotes the electric power generator/motor, and is attached to the toner stirring member 32. The electric power generator/motor 350 converts the operation of the toner stirring member 32 by the shaking to electric power. The converted electric power is stored in the storage circuit 302 shown in FIG. 21.

The electric power generator/motor 350 is connected to the control unit 11 by way of a driver 400, and electric power is supplied to the electric power generator/motor 350 through the driver 400 after the toner cartridge 3 is attached to the toner replenishing device 4 to rotate the toner stirring member 32.

Therefore, in the present embodiment, the toner can be continuously stirred by the driving force of the electric power generator/motor 350 even after the shaking of the toner cartridge 3 is stopped, thereby preventing re-coagulation of the toner.

Eighth Embodiment

The configuration having the toner stirring member 32 inside the toner cartridge 3 is adopted in the fifth to the seventh embodiments, but the toner stirring member 32 does not necessarily need to be arranged since the toner inside can be stirred by shaking the toner cartridge 3. In the present embodiment, a mode where the toner stirring member 32 is not arranged will be described.

Figure 22:
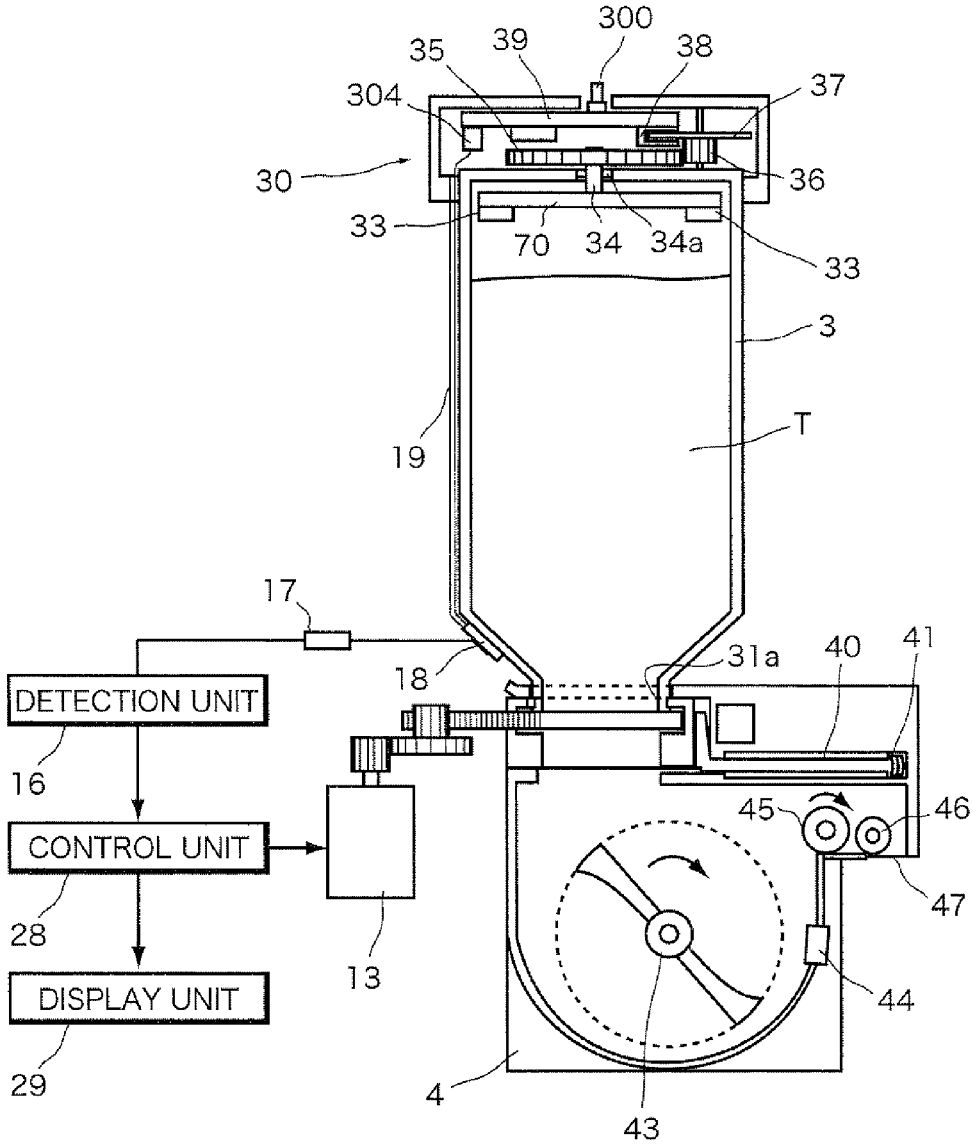
FIG. 22 is a frame format view describing a configuration of a toner replenishing device according to an eighth embodiment.

FIG. 22 is a frame format view describing a configuration of the toner replenishing device 4. In the present embodiment, a rotating body which rotates in response to the shaking of the toner cartridge 3 is arranged inside the toner cartridge 3.

Figure 23A:
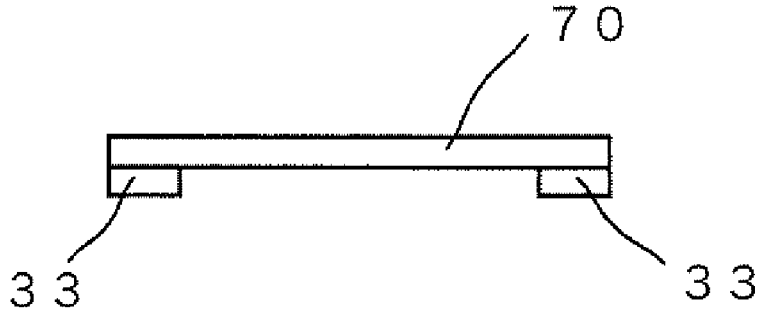
FIGS. 23A and 23B are frame format views showing a rotating body inside the toner cartridge.
Figure 23B:
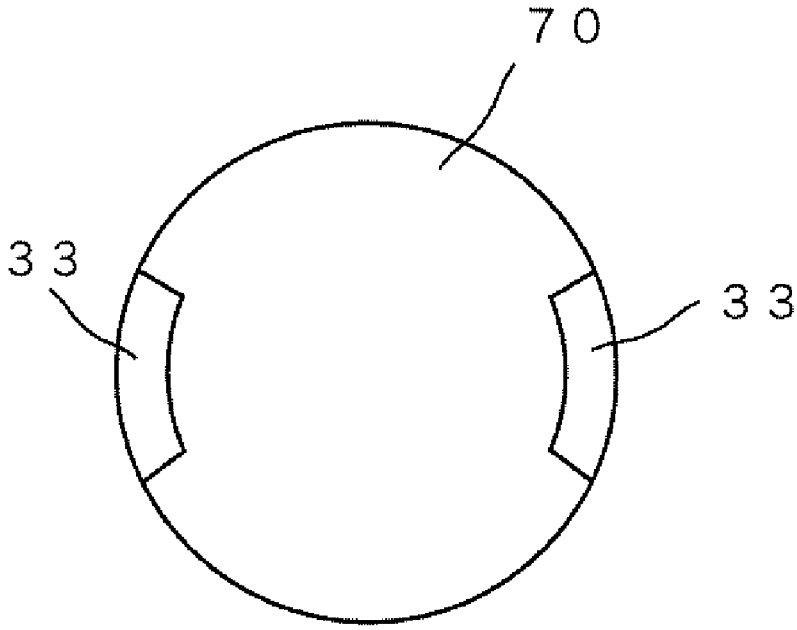

FIGS. 23A and 23B are a frame format view showing the rotating body inside the toner cartridge 3. FIG. 23A shows a side view of the rotating body, and FIG. 23B shows a plan view of the rotating body. The rotating body includes a circular disc 70 attached to the rotation shaft 34 for axially supporting in a freely rotating manner the rotation gear 35 in the electric power generation unit 30, and eccentric spindles 33, 33 attached to the ends in the circumferential direction of the circular disc 70.

The rotating body of such configuration rotates by the shaking of the toner cartridge 3. In the present embodiment, the shaking amount of the toner cartridge 3 (number of rotations of the rotating body) can be accurately detected by detecting the rotation of the rotating body as the induced electromotive force generated at the induction coil 38.

As this technology may be embodied in several forms without departing from the spirit of essential characteristics thereof, the present embodiments are therefore illustrative and not restrictive, since the scope of the technology is defined by the appended claims rather than by description preceding them, and all changes that fall within metes and bounds of the claims, or equivalence of such metes and bounds thereof are therefore intended to be embraced by the claims.

What is claimed is:

1. A toner cartridge for containing toner, the containing toner being stirred by shaking, comprising:

a counting unit for counting the number of shaking movements that are performed on the toner cartridge by an installer.

2. The toner cartridge according to claim 1, further comprising a packaging detection unit for detecting whether packaged or not; wherein the counting unit maintains a counting result to zero when the packaging detection unit detects that the toner cartridge is packaged.

3. The toner cartridge according to claim 1, wherein the counting unit includes a pendulum which swings in at least one direction, a contacting point to which the pendulum contacts, and a counter for counting the number of times the pendulum has contacted the contacting point.

4. The toner cartridge according to claim 3, wherein a shape of the toner cartridge is a columnar shape, and the pendulum swings in a direction along a longitudinal direction.

5. The toner cartridge according to claim 3, wherein the pendulum swings in a plurality of directions, and the contacting point is arranged in correspondence to each of the plurality of swinging directions of the pendulum.

6. The toner cartridge according to claim 1, further comprising a display unit for displaying a counting result by the counting unit.

7. The toner cartridge according to claim 1, further comprising:

a determining unit for determining whether or not a counting result by the counting unit is greater than or equal to a predetermined value; and a display unit for displaying a notification that the toner cartridge needs to be shaken when determined as negative by the determining unit.

8. An image forming apparatus comprising:

a developing unit for developing a toner image by making toner adhere to an electrostatic latent image formed on a surface of a photosensitive body;

a transfer unit for transferring the toner image developed by the developing unit on a recording sheet;

a toner cartridge according to claim 1 being removably attached so that the toner contained in the attached toner cartridge is supplied to the developing unit; and a control unit for controlling the supply of toner to the developing unit based on a counting result of a counting unit arranged in the toner cartridge.

9. The image forming apparatus according to claim 8, wherein the control unit determines whether or not the counting result is greater than or equal to a predetermined value, and prohibits the supply of toner if determined as negative.

10. The image forming apparatus according to claim 8, further comprising a notifying unit for notifying the counting result.

11. The image forming apparatus according to claim 8, further comprising;

a determining unit for determining whether or not the counting result is greater than or equal to a predetermined value; and a notifying unit for notifying that the toner cartridge needs to be shaken when the determining unit determines negative.

12. A toner cartridge for containing toner, the containing toner being stirred by shaking, comprising:

a conversion unit for converting energy related to shaking movements to electric power; and a storage unit for storing the electric power converted by the conversion unit.

13. The toner cartridge according to claim 12, further comprising a detection unit for detecting a shaking amount based on the electric power stored in the storage unit; and a display unit for displaying the shaking amount detected by the detection unit.

14. The toner cartridge according to claim 12, wherein a rotating body rotatably supported by a predetermined rotation shaft is internally arranged, the rotating body being configured to rotate about the rotation shaft by the shaking.

15. The toner cartridge according to claim 14, wherein a stirring member for stirring the toner is attached to the rotating body.

16. The toner cartridge according to claim 12, further comprising a discharge unit for discharging the electric power stored by the storage unit.

17. An image forming apparatus comprising:

a developing unit for developing a toner image by making toner adhere to an electrostatic latent image formed on a surface of a photosensitive body;

a transfer unit for transferring the toner image developed by the developing unit on a recording sheet;

an attachment unit to which the toner cartridge according to claim 12 is removably attached; and a replenishing unit for replenishing to the developing unit the toner contained in the toner cartridge attached to the attachment unit.

18. The image forming apparatus according to claim 17, further comprising:

a detection unit for detecting electric power stored in the toner cartridge; and a control unit for controlling a replenishing operation of the toner by the replenishing unit according to the detection result of the detection unit.

19. The image forming apparatus according to claim 18, further comprising:

a determining unit for determining whether or not the electric power detected by the detection unit is greater than or equal to a predetermined value; and a notifying unit for notifying that the toner cartridge needs to be shaken when the determining unit determines negative.

20. The image forming apparatus according to claim 19, wherein the toner cartridge includes a toner replenishing valve, the toner replenishing valve being opened by the control of the control unit when determined that the electric power detected by the detection unit is greater than or equal to the predetermined value.

* * * * *